US010184243B2

(12) United States Patent
Hamilton et al.

(10) Patent No.: US 10,184,243 B2
(45) Date of Patent: Jan. 22, 2019

(54) EXPANSION JOINT SEAL AND EXPANSION JOINT

(71) Applicant: WATSON BOWMAN ACME CORPORATION, Amherst, NY (US)

(72) Inventors: Neil Hamilton, Sanborn, NY (US); Gary Moore, Orchard Park, NY (US)

(73) Assignee: Watson Bowman Acme Corporation, Amherst, NY (US)

( * ) Notice: Subject to any disclaimer, the term of this patent is extended or adjusted under 35 U.S.C. 154(b) by 0 days.

(21) Appl. No.: 15/545,593

(22) PCT Filed: Feb. 2, 2016

(86) PCT No.: PCT/US2016/016119
§ 371 (c)(1),
(2) Date: Jul. 21, 2017

(87) PCT Pub. No.: WO2016/126673
PCT Pub. Date: Aug. 11, 2016

(65) Prior Publication Data

US 2018/0010330 A1 Jan. 11, 2018

Related U.S. Application Data

(60) Provisional application No. 62/114,268, filed on Feb. 10, 2015, provisional application No. 62/110,900, filed on Feb. 2, 2015.

(51) Int. Cl.

| | |
|---|---|
| ***E04B 1/00*** | (2006.01) |
| ***E04B 1/68*** | (2006.01) |
| ***E01C 11/10*** | (2006.01) |
| ***E01C 11/12*** | (2006.01) |

(52) U.S. Cl.
CPC ..... *E04B 1/6803* (2013.01); *E01C 11/10* (2013.01); *E01C 11/106* (2013.01); *E01C 11/126* (2013.01)

(58) Field of Classification Search
CPC ..... E04B 1/6803; E01C 11/10; E01C 11/106; E01C 11/126
USPC ..... 404/47–70
See application file for complete search history.

(56) References Cited

U.S. PATENT DOCUMENTS

| | | | |
|---|---|---|---|
| 3,323,426 | A | 6/1967 | Hahn |
| 3,339,329 | A | 9/1967 | Berg |
| 3,396,640 | A | 8/1968 | Fujihara |
| 3,897,073 | A | 7/1975 | Swanson et al. |

(Continued)

OTHER PUBLICATIONS

PCT/US2016/016119—International Search Report, dated May 16, 2016.

(Continued)

*Primary Examiner* — Raymond W Addie
(74) *Attorney, Agent, or Firm* — Curatolo Sidoti Co., LPA; Salvatore A. Sidoti; Peter J. Beardsley

(57) ABSTRACT

An expansion joint seal for sealing a gap between two structural members that includes a coverplate, a snap-fit connector extending downwardly from the coverplate, a central spine connected to the coverplate with a snap-fit connector and extending downwardly from the connector, and foam seal members engaged with the central spine of the expansion joint seal. An expansion joint including spaced-apart structural members defining a gap between the spaced-apart members and the expansion joint seal.

24 Claims, 15 Drawing Sheets

(56) References Cited

U.S. PATENT DOCUMENTS 4,058,947 A 11/1977 Earle et al.
4,067,155 A 1/1978 Ruff et al.
4,346,542 A * 8/1982 Tateno ..... E01C 11/10 404/48
4,784,516 A * 11/1988 Cox ..... E01C 11/10 14/73.1
5,888,017 A * 3/1999 Corrie ..... E01C 11/106 404/64
6,039,503 A * 3/2000 Cathey ..... E01C 11/10 14/73.1
6,491,468 B1 * 12/2002 Hagen ..... E04B 1/6803 277/316
6,532,708 B1 * 3/2003 Baerveldt ..... E01D 19/06 404/47
7,895,802 B2 * 3/2011 Kurz ..... E04F 15/02005 52/395
8,646,237 B1 * 2/2014 Takagi ..... E04B 1/7629 52/464
8,813,450 B1 * 8/2014 Hensley ..... E04B 1/6804 52/396.01
8,826,481 B1 * 9/2014 Haydu ..... E01D 19/06 14/73.5
8,887,463 B2 * 11/2014 Derrigan ..... E02D 17/10 404/25
8,966,847 B2 * 3/2015 Kessler ..... E04B 1/6804 52/395
9,169,660 B2 * 10/2015 Plenet ..... E04F 19/063
9,765,486 B1 * 9/2017 Robinson ..... E01C 11/126
2004/0154255 A1 8/2004 Jesko
2005/0005553 A1 1/2005 Baerveldt
2010/0031596 A1 2/2010 Muehlebach

OTHER PUBLICATIONS

PCT/US2016/016119—International Written Opinion, dated May 16, 2016.

* cited by examiner

EXPANSION JOINT SEAL AND EXPANSION JOINT

CROSS REFERENCE TO RELATED APPLICATIONS

This application is a national stage application of International Application No. PCT/US2016/016119, filed 2 Feb. 2016, which claims the benefit of the filing dates from U.S. Provisional Application For Patent Ser. No. 62/110,900, filed 2 Feb. 2015and U.S. Provisional Application For Patent Ser. No. 62/114,268 filed 10 Feb. 2015, both of which applications are incorporated herein by reference.

TECHNICAL FIELD

Disclosed is an expansion joint seal for sealing a gap between two structural members. The expansion joint seal forms a bridge across a gap or opening between two structural members to permit a smooth transition of pedestrian traffic across the gap or opening between the two structural members.

Expansion joint sealing systems are essentially covers that bridge a gap or opening across expansion joints to provide pedestrian or vehicular passage over the joint, and provide a smooth transition from one structural member to another, while not preventing the joint movement. The coverplate of the expansion joint sealing system should remain centered in a "neutral" position across the expansion joint gap after exposure to thermal cycling and seismic movements. It is known to use complex mechanical centering devices or elastic elements to in an attempt to maintain the coverplate of the expansion joint system centered across the gap of the expansion joint.

SUMMARY

Disclosed is an expansion joint seal comprising a coverplate, a snap-fit connecting member depending downwardly from said coverplate, a central spine connected to said snap-fit connecting member and extending downwardly from said connecting member, and an expandable and compressible foam seal member positioned engaged with said central spine.

According to certain illustrative embodiments, the expansion joint seal comprises a coverplate, a snap-fit connecting member depending downwardly from said coverplate, a central spine connected to said snap-fit connecting member and extending downwardly from said connecting member, and at least one piece of expandable and compressible foam seal positioned on each side of said central spine.

Additionally disclosed is an expansion joint comprising spaced-apart structural members defining a gap therebetween and an expansion joint seal covering said gap between said spaced-apart structural members, said expansion joint seal comprising a coverplate, a snap-fit connecting member depending downwardly from said coverplate, a central spine connected to said snap-fit connecting member and extending downwardly from said connecting member, and an expandable and compressible foam seal member positioned engaged with said central spine.

According to certain illustrative embodiments, the expansion joint comprises spaced-apart structural members defining a gap therebetween and an expansion joint seal covering said gap between said spaced-apart structural members, said expansion joint seal comprising a coverplate, a snap-fit connecting member depending downwardly from said coverplate, a central spine connected to said snap-fit connecting member and extending downwardly from said connecting member, and at least one piece of expandable and compressible foam seal positioned on each side of said central spine.

Further disclosed is an expansion joint comprising spaced-apart structural members defining a gap therebetween, wherein each of said spaced-apart structural members comprises at least one horizontal tread portion and at least one vertical riser portion, and an expansion joint seal covering said gap between said spaced-apart structural members, said expansion joint seal comprising a coverplate, a snap-fit connecting member depending downwardly from said coverplate, a central spine connected to said snap-fit connecting member and extending downwardly from said connecting member, and an expandable and compressible foam seal member positioned engaged with said central spine.

According to certain embodiments, the expansion joint comprises spaced-apart structural members defining a gap therebetween, wherein each of said spaced-apart structural members comprises at least one horizontal tread portion and at least one vertical riser portion, and an expansion joint seal covering said gap between said spaced-apart structural members, said expansion joint seal comprising a coverplate, a snap-fit connecting member depending downwardly from said coverplate, a central spine connected to said snap-fit connecting member and extending downwardly from said connecting member, and at least one piece of expandable and compressible foam seal positioned on each side of said central spine.

Further disclosed is a method for covering an expansion joint, said method comprising positioning an assembly comprising a central spine and at least one piece of expandable and compressible foam seal engaged with said central spine into a gap between spaced-apart structural members, positioning a coverplate across said gap, and connecting said coverplate to said central spine with a snap-fit connector.

According to certain illustrative embodiments, the method of making an expansion joint comprises forming spaced-apart structural members having a gap defined therebetween, positioning an assembly comprising a central spine and at least one piece of expandable and compressible foam seal engaged with said central spine into a gap between spaced-apart structural members, positioning a coverplate across said gap, and connecting said coverplate to said central spine with a snap-fit connector.

BRIEF DESCRIPTION OF THE DRAWINGS

The expansion joint seal will be more fully understood when the following description is read in view of the accompanying drawings in which:

FIGS. 116A and 16B are an axonometric and side views of embodiments of the sealed expansion joint system.

DETAILED DESCRIPTION

Figure 1:
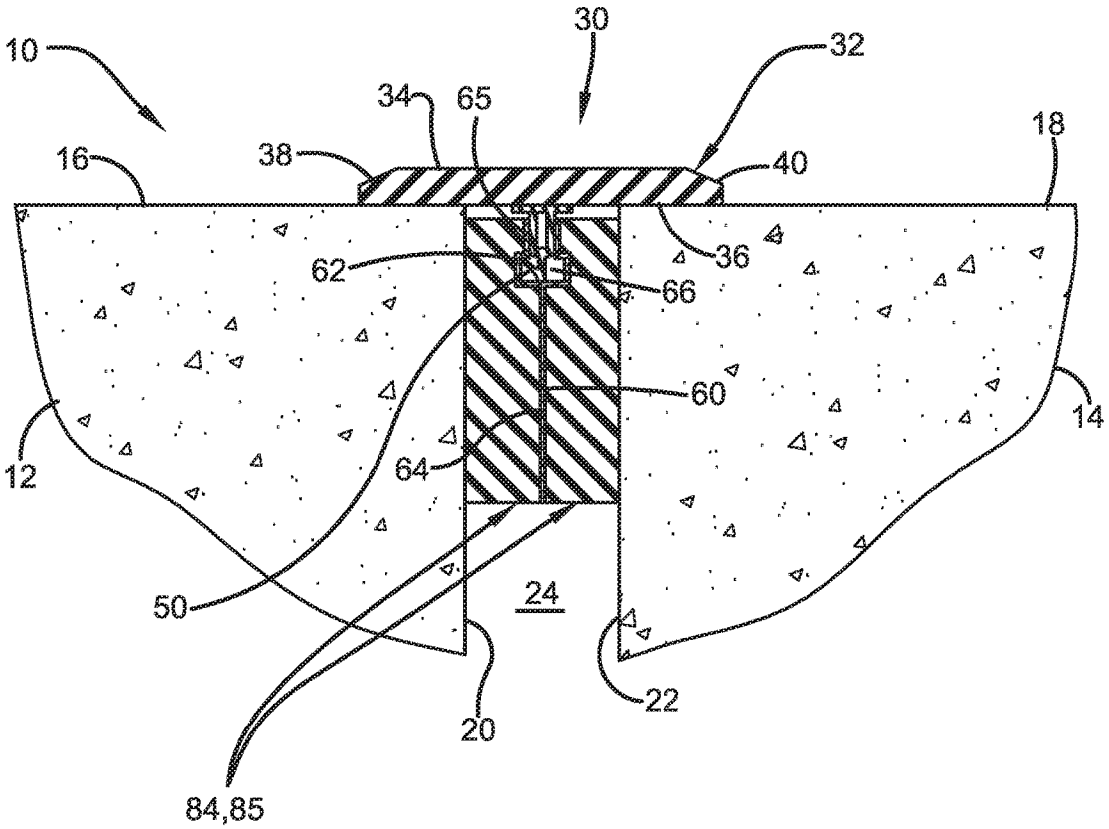
FIG. 1 is a cross-sectional view of a first illustrative embodiment of the expansion joint sealing system.

Disclosed is an expansion joint seal for bridging or otherwise spanning across a gap formed between spaced-apart structural members, such as two spaced-apart concrete structural members. The expansion joint seal comprises a coverplate that has a width sufficient to bridge the gap between the two spaced-apart structural members and that is connected to a self-centering mechanism by a snap-fit connecting member. The snap-fit connector extends downwardly in from the bottom surface of the coverplate of the expansion joint seal. According to certain illustrative embodiments, the snap-fit connector extends downwardly from the bottom surface of the coverplate in a substantially perpendicularly manner in relation to the horizontally extending coverplate. The use of a snap-fit connection between the coverplate and the central spine eliminates the need for additional fasteners to attach to the coverplate to the central spine and therefore reduces the complexity of the installation process and associated labor, and eliminates holes located on the surface of the coverplate where water or other debris can enter into the expansion joint space.

The self-centering mechanism of the expansion joint seal comprises a central spine member, and resilient foam seal member or members having compressible and expandable properties. The central spine is connected to the coverplate by the snap-fit connector and extends downwardly from the connecting member. The central spine includes an open cavity portion for accepting the snap-fit connector and an elongated rib portion extending downwardly from the cavity portion. According to certain illustrative embodiments, the central spine extends downwardly from the end of the snap-fit connector substantially along the longitudinal axis of the snap-fit connector. The expandable and compressible foam seal is positioned on each side of the central spine. According to certain embodiments, at least one separate piece of the foam seal may be positioned on each side of the central spine. According to other illustrative embodiments, the foam seal may be provided as a single piece having a groove formed within a portion of the foam seal piece. The elongated rib portion of the central spine may be inserted into the groove of the foam, resulting in foam seal being positioned on each side of the central spine. The foam seal occupies the space in the expansion joint gap between the spaced-apart structural members and the central spine. According to certain embodiments, the foam member may comprise a foam section having one or more voids. According to certain embodiments, the foam member(s) having one or more voids may approximate the profile of a glandular expansion joint seal that are widely known in the art.

According to certain illustrative embodiments, without limitation, and only by way of example, the coverplate may comprise a metal, a metal alloy, a rigid plastic, an elastomer, or a composite material. According to certain embodiments, the coverplate comprises a rigid plastic material. According to certain embodiments, the snap-fit connector comprises a rigid plastic material. According to yet further embodiments, both the coverplate and the snap-fit connector comprise a rigid plastic material. For embodiments where both the coverplate and the snap-fit connection comprise a rigid plastic material, the coverplate may be connected to the snap-fit connector by a plastic welding process involving a plastic weld material that joins the coverplate to the snap-fit connector. According to other embodiments, the coverplate and the snap-fit connecter may comprise a single extruded integral piece of rigid plastic material.

According to other embodiments, the coverplate of the expansion joint seal may comprise a metal or metal alloy. Without limitation, and only by way of illustration, the metal or metal alloy may comprise rolled steel, stainless steel, galvanized steel and aluminum plates.

According to certain illustrative embodiments, the coverplate of the expansion joint seal comprises an elastomeric material. Without limitation, and only by way of illustration, the elastomeric material may be selected from butadiene rubber, styrene-butadiene rubber, butyl rubber, ethylene-propylene rubber, ethylene-propylene-diene rubber, polyisoprene rubber, polychloroprene rubber, silicon rubber, nitrile rubber and blends thereof. According to certain embodiments, the elastomeric material comprises ethylene-propylene-diene rubber. The cover may be constructed of elastomeric material containing fillers and a precisely chosen amount of a plasticizer to yield a rubber material having a durometer reading of about 80. The term "elastomeric" refers for a material that possesses rubber-like properties, for example, an elastomeric material will substantially recover its original dimensions after compression and/or elongation. Any elastomeric material may be used to prepare the resilient cover, so long as the cover can be prepared to a thickness and sufficient elasticity to elastically deform to establish supporting contact between the marginal support areas of the cover assembly and the underlying horizontal structural members to provide a smooth transition over the gap or opening for pedestrian or vehicular traffic. Ethylene-propylene-diene rubber (EPDM) is utilized to prepare the cover. A suitable EPDM rubber composition that is useful to prepare the cover is commercially available from Advanced Elastomer Systems, L.P. (Akron, Ohio, USA) under the trade name Santoprene™.

According to certain embodiments, the elastomeric coverplate comprises an elongated resilient elastomeric cover having a load bearing surface opposite a support surface including marginal support areas along opposite lateral edges thereof. The cover has a thickness and sufficient elasticity to elastically deform for establishing supporting contact between marginal support areas and underlying horizontal structural members adjacent to a gap between horizontal structural members. At least one rigid plate member is encapsulated within the elongated elastomeric cover for bridging a gap between the horizontal structural members.

According to certain embodiments, the coverplate comprises an elongated resilient cover having a predetermined width sufficient to overlie portions of horizontal structural members outwardly of marginal edges to a gap between the horizontal structural members, and a rigid plate member secured by and encapsulated within the elongated resilient cover. The rigid plate member defines an elongated bridging member having a width sufficient to span the width of a gap between horizontal structural members.

The elongated resilient cover may comprise peripheral edges including tapered face surfaces for providing incline planes to bear traffic traversing the coverplate. The upper load bearing surface of the elongated resilient cover includes spaced apart upstanding ribs arranged to extend transversely to the direction of traffic traversing the cover.

According to certain embodiments, multiple rigid plates may be encapsulated within the elastomer cover of the coverplate of the expansion joint seal. In addition to a central rigid plate member having a width sufficient to bridge the gap across the expansion joint, the seal may further comprise at least two rigid plate members secured by and encapsulated within the elongated resilient cover and which extend along opposite lateral sides of the central rigid plate member in a side-by-side manner.

According to certain illustrative embodiments, the snap-fit connecter may be connected to the rigid plastic, metal, or elastomeric coverplate by a dovetail joint.

The central spine may comprise a metal, metal alloy, plastic, or composite material. According to certain embodiments, the central spine comprises a metal. According to certain embodiments, the central spine comprises aluminum.

The central spine of the expansion joint seal comprises means for accepting a portion of the snap-fit connector and an elongated rib extending downwardly from the means for accepting. The means for accepting comprises an upper passageway that is in communication with a lower cavity portion. The upper passageway is defined by spaced-apart vertical side walls and upper and lower ends. The lower cavity comprises spaced-apart vertical side walls having upper and lower ends, a horizontal bottom wall connected to the lower ends of the spaced-apart cavity side walls, and horizontal top wall portions connected to the upper ends of said spaced-apart cavity side walls. The upper passageway first a first width defined by its spaced-apart side walls. The lower cavity has a width defined by its spaced-apart side walls. The upper passageway has a width that is less than the width of the lower cavity.

The cavity top wall portions are connected to the lower ends of the passageway side walls to form an abutment surface for the snap-fit connector. The snap-fit connector comprises a horizontally extending top wall, spaced-apart side walls, a lower connecting segment connecting the side walls together. A tab member extends downwardly from the lower connecting segment and includes upper and lower ends. The tab also includes a flange portion extending upwardly and outwardly from the lower end of the tab in a substantially diagonal manner in relation to the tab. The snap-fit connector is inserted into the upper passageway of the means for accepting of the central spine. The side walls of snap-fit connector are in abutting contact with the upper passageway side walls, and the tab of said snap-fit connector extends downwardly into the lower cavity of the means for accepting of the central spine.

The expansion joint seal incorporates a snap-fit connector that is used to join the cover of the expansion joint seal to the central spine. The snap-fit connector broadly includes both locating and locking components. The locking component(s) of the snap-fit connector possesses a certain level of flexibility that permits the locking component(s) to bend from its original position during engagement with the central spine of the expansion joint seal, and to return to its original position once the snap-fit connector is engaged in its intended position with the central spine. The flexibility of the locking component of the snap-fit connector is intended to enable the snap-fit connector to be easily engaged in its intended position with the central spine and to enable the connector to create an interference with the central spine in response to movement within an expansion joint to prevent the cover of the expansion joint seal from becoming disengaged from the expansion joint seal.

According to certain illustrative embodiments, the snap-fit connector comprises a horizontally extending top wall, spaced-apart side walls that extend downwardly from the bottom surface of the horizontally extending top wall, and a lower connecting segment connecting the side walls together. The side walls and the lower connecting segment together are may be a continuous element. The snap-fit connector includes a locking member that depends downwardly from the lower connecting segment of the connector. The locking member includes a leg member that extends downwardly from the lower connecting segment and which includes upper and lower ends. The locking member also includes a flange portion that extends upwardly and outwardly from the lower end of the leg.

According to other illustrative embodiments, the snap-fit connector comprises a horizontally extending top wall, spaced-apart side walls that extend downwardly from the bottom surface of the horizontally extending top wall, and a lower connecting segment connecting the side walls together. The side walls and the lower connecting segment together may be a continuous element. The spaced-apart side walls of the connector have opposite upper and lower ends. The spaced-apart side walls of the connector extend downwardly from the bottom surface of the horizontally extending top wall in a substantially perpendicular manner in relation to the horizontally extending top wall. According to certain embodiments, the spaced-apart side walls of the connector also extend downwardly from the bottom surface of the horizontally extending top wall in a substantially parallel manner in relation to one another. The lower ends of each of the side walls extend inwardly at an angle toward each other and are connected by the lower connecting segment. Flange members extend upwardly and outwardly from opposite sides of the lower connecting segment. The flange portions extend upwardly and outwardly from lower connecting segment in opposite directions. According to certain embodiments, the flange portions extend upwardly and outwardly from the lower connecting segment in a manner that is substantially parallel to the angle of the lower ends of the side walls of the snap-fit connector.

According to other illustrative embodiments, the snap-fit connector comprises a horizontally extending top wall, spaced-apart side walls that extend downwardly from the bottom surface of the horizontally extending top wall. The spaced-apart side walls of the connector have opposite upper and lower ends. The spaced-apart side walls of the connector extend downwardly from the bottom surface of the horizontally extending top wall in a substantially perpendicular manner in relation to the horizontally extending top wall. According to certain embodiments, the spaced-apart side walls of the connector also extend downwardly from the bottom surface of the horizontally extending top wall in a substantially parallel manner in relation to one another. The lower ends of each of the side walls extend inwardly at an angle toward each other, i.e., toward the midline of the snap-fit connector. The lower ends of the spaced-apart side walls terminate in a horizontally extending bottom wall. The bottom walls extend in a horizontal manner away from the midline of the snap-fit connector. Flange members extend upwardly and outwardly from terminal ends of each of the bottom walls. The flange portions extend upwardly and outwardly from the bottom walls in opposite directions. According to certain embodiments, the flange portions extend upwardly and outwardly from the bottom walls in a manner that is substantially parallel to the angle of the lower ends of the side walls of the snap-fit connector.

The foam seal members of the self-centering mechanism of the expansion joint seal may comprise a closed cell foam or an impregnated open cell foam. According to certain embodiments, the foam seal component comprises a closed cell foam neoprene foam. Without limitation, a suitable closed cell neoprene foam is commercially available from Alloy Extrusion Company (Brimfield, Ohio, USA) under the registered trademark ELASTALLOY®. According to other embodiments, closed or open cell foams such as neoprene, blended neoprene silicone, silicone, blended fluorinated silicone, and impregnated polyurethane and silicone foams may be used.

Also disclosed is an expansion joint comprising spaced-apart structural members defining a gap between the two members and any of the above-described embodiments of the expansion joint seal covering the gap between the two spaced-apart structural members. Generally, the expansion joint seal comprises a coverplate, a snap-fit connector depending downwardly from the coverplate, a central spine connected to the coverplate by the snap-fit connector and extending downwardly from the connecting member, and expandable and compressible foam seal positioned on each side of the central spine.

According to certain illustrative embodiments, the expansion joint comprises spaced-apart structural members defining a gap between the two members and each member having at least one horizontal tread portion and at least one vertical riser portion, and an expansion joint seal of any one of the above-described embodiments covering the gap between the spaced-apart structural members. Generally, the expansion joint seal comprises a coverplate, a snap-fit connector depending downwardly from the coverplate, a central spine connected to the coverplate by the snap-fit connector and extending downwardly from the connecting member and expandable and compressible foam seal positioned on each side of the central spine.

Certain illustrative embodiments of the expansion joint system will now be described in greater detail with reference to the drawing FIGURES. It should be noted that the expansion joint seal and expansion joint incorporating the expansion joint seal are not intended to be limited to the illustrative embodiments shown the drawing FIGURES, but shall include all variations and modifications within the scope of the claims.

FIG. 1 depicts a first illustrative embodiment of the expansion joint seal installed across an expansion joint having a gap or opening formed between two spaced-apart concrete structural members. The expansion joint 10 comprises two spaced-apart structural members 12, 14. Each of structural members 12, 14 includes horizontally extending top surfaces 16, 18 and vertically extending marginal side faces 20, 22. A gap or opening 24 is formed in the space between marginal side faces 20, 22 of spaced-apart structural members 12, 14. According to the first illustrative embodiment depicted in FIG. 1, the expansion joint seal 30 includes a horizontally extending rigid plastic coverplate 32 having opposite facing top 34 and bottom 36 surfaces, and incline planes 38, 40 located on opposite longitudinal sides of the coverplate 32 for promoting a smooth transition across the coverplate 32. Coverplate 32 also includes a desired thickness 42 extending between the top 34 and bottom 36 surfaces. According to the embodiment of FIG. 1, a connector means 50 extends downwardly from the bottom surface 36 of the coverplate 32.

Figure 4:
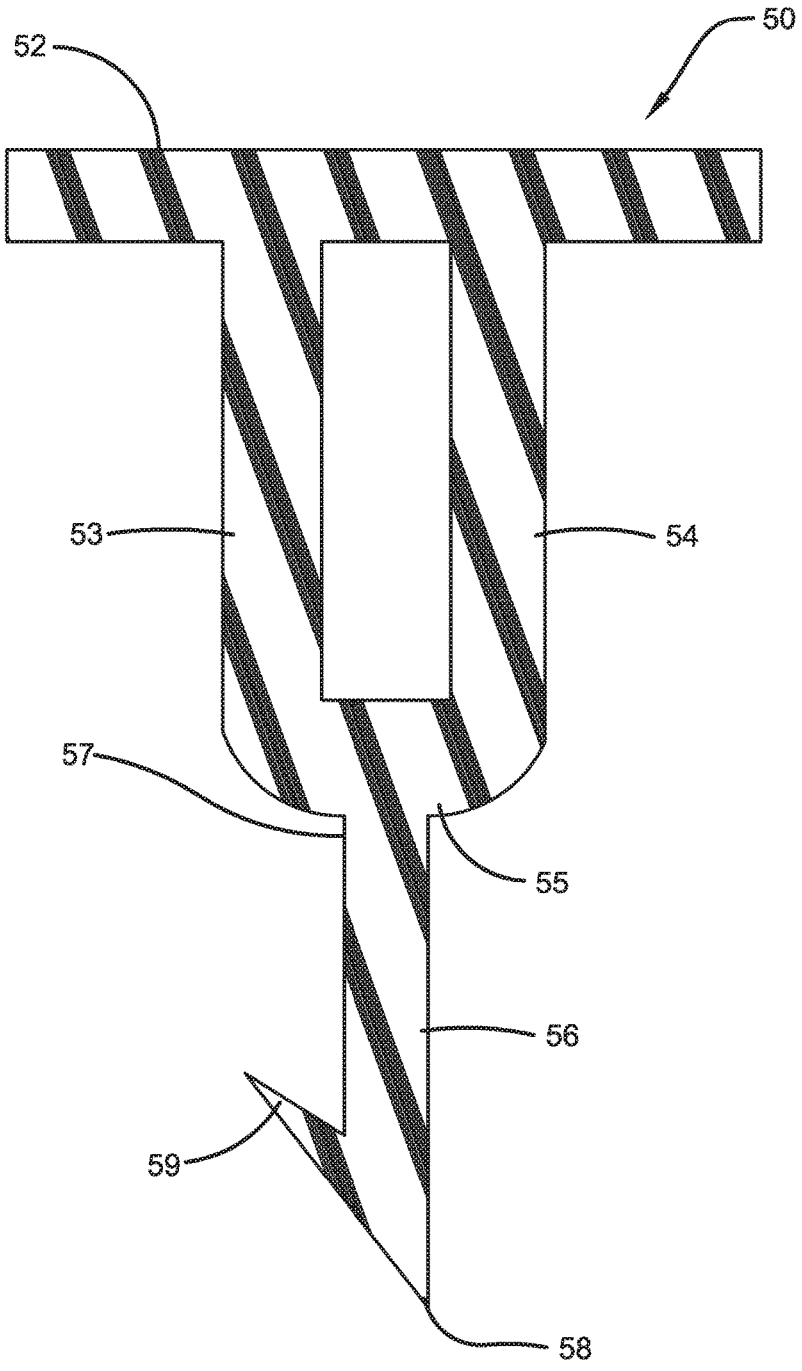
FIG. 4 is a cross-sectional view of an illustrative embodiment of the snap-fit connector.

As shown in FIG. 4, the connector comprises a snap-fit connector 50 that extends downwardly from the coverplate 32. The snap-fit connector 50 comprises a horizontally extending top wall 52, spaced-apart side walls 53, 54, a lower connecting segment 55 connecting said side walls 53, 54 together, and a tab 56 extending downwardly from said lower connecting segment 55 and having upper and lower ends 57, 58, said tab 56 comprising a flange 59 portion extending upwardly and outwardly from said lower end 58 of said tab 56. The horizontally extending top wall 52 of the snap-fit connector 50 is attached to the bottom surface 36 of the coverplate with a plastic material such as high density polyethylene.

Figure 5:
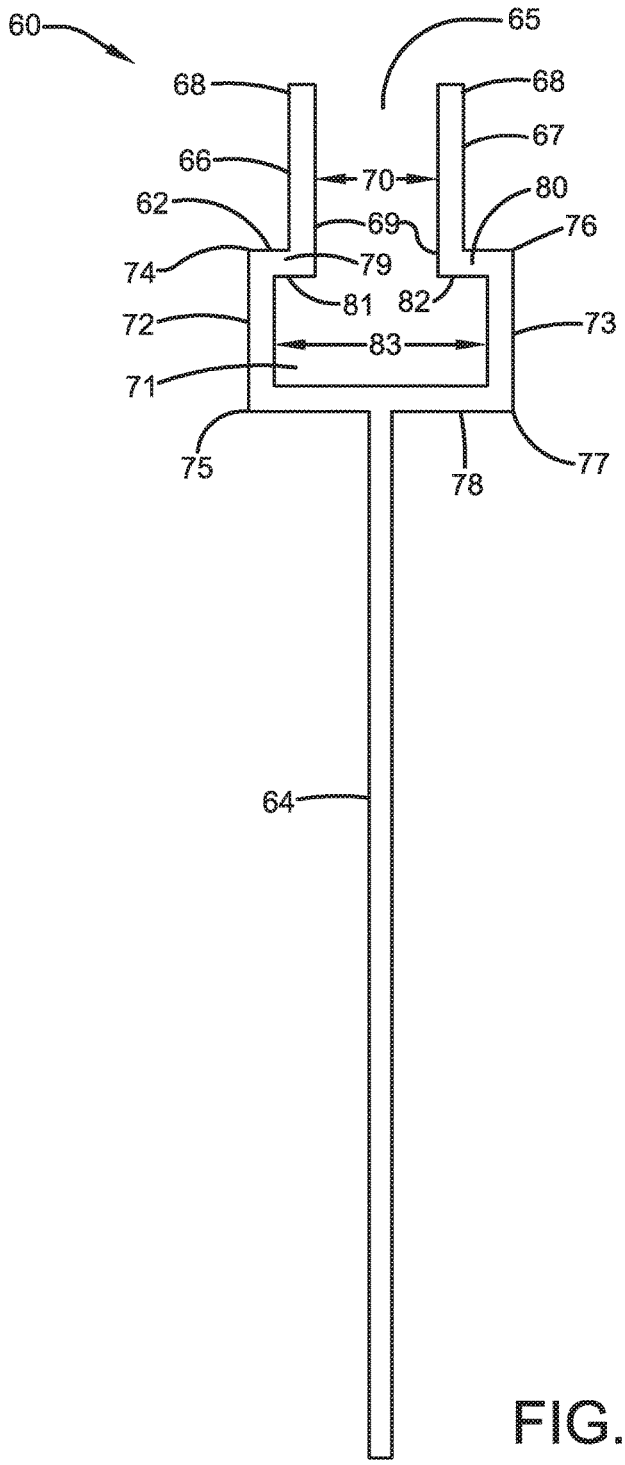
FIG. 5 is a cross-sectional view of an illustrative embodiment of the central spine.

Referring again to FIG. 1, a central spine 60 connected to the coverplate 32 by the snap-fit connector 50 and extends downwardly from the connecting member 50. Now referring to FIG. 5, the central spine 60 comprises means for accepting 62 a portion of the snap-fit connector 50 and an elongated rib 64 extending downwardly from the means for accepting 62 the snap-fit connector 50. The means for accepting 62 the snap-fit connector 50 comprises an upper passageway 65 that is in communication a lower cavity 66. The upper passageway 65 is defined by spaced-apart vertical side walls 66, 67 and upper and lower ends 68, 69. The distance between the spaced-apart vertical side walls 66, 67 define a first width 70 of the upper passageway 65. The lower cavity portion 71 of the means for accepting 62 the snap-fit connector 50 comprises spaced-apart vertical side walls 72, 73 having upper and lower ends 74-77, a horizontal bottom wall 78 that are connected to the lower ends 75, 77 of the spaced-apart cavity side walls 72, 73, and horizontal top wall portions 79, 80 that are connected to the upper ends 74, 76 of the spaced-apart cavity side walls 72, 73. As described in greater detail below, the cavity top wall portions 79, 80 are connected to the upper ends 74, 76 of said cavity 71 side walls 72, 73, and the lower ends 69 of the passageway 65 side walls 66, 67, and form abutment surfaces 81, 82 for the snap-fit connector 50. The distance between the cavity side walls 72, 73 define a width 83 of the lower cavity 71 that is less than the greater than the width 70 of the upper passageway 65.

Referring again to FIG. 1, resilient foam seal sections 84, 85 are positioned on each side of the downwardly extending rib 64 of the central spine 64, and occupy the space between the opposite facing surfaces of the downwardly extending rib 64 and the marginal side wall faces 20, 22 of the spaced-apart structural members 12, 14. The snap-fit connector 50 is inserted into the upper passageway 65 of the means for accepting 62 of said central spine 60. The side walls 53, 54 of snap-fit connector 50 are in abutting contact with the side walls 66, 67 of the upper passageway 65 of the means for accepting 62 of the central spine 60. The tab 56 of the snap-fit connector 50 extends downwardly into the lower cavity 71 of the means for accepting 62 of the central spine 60. When the expansion joint seal is at "rest" with the bottom surface 36 of the metal coverplate 32 resting on the horizontally extending top surfaces 16, 18 of the spaced-apart structural members 12, 14, there is a clearance between the flange 59 of the tab 56 and the abutment surface 81. In the event of thermal cycling and/or seismic movement, the flange of the tab 59 would contact into abutting contact with abutment surface 81, thereby keeping the coverplate 32 positioned over the gap of the expansion joint and preventing it from being pulled out of the expansion joint.

Figure 2:
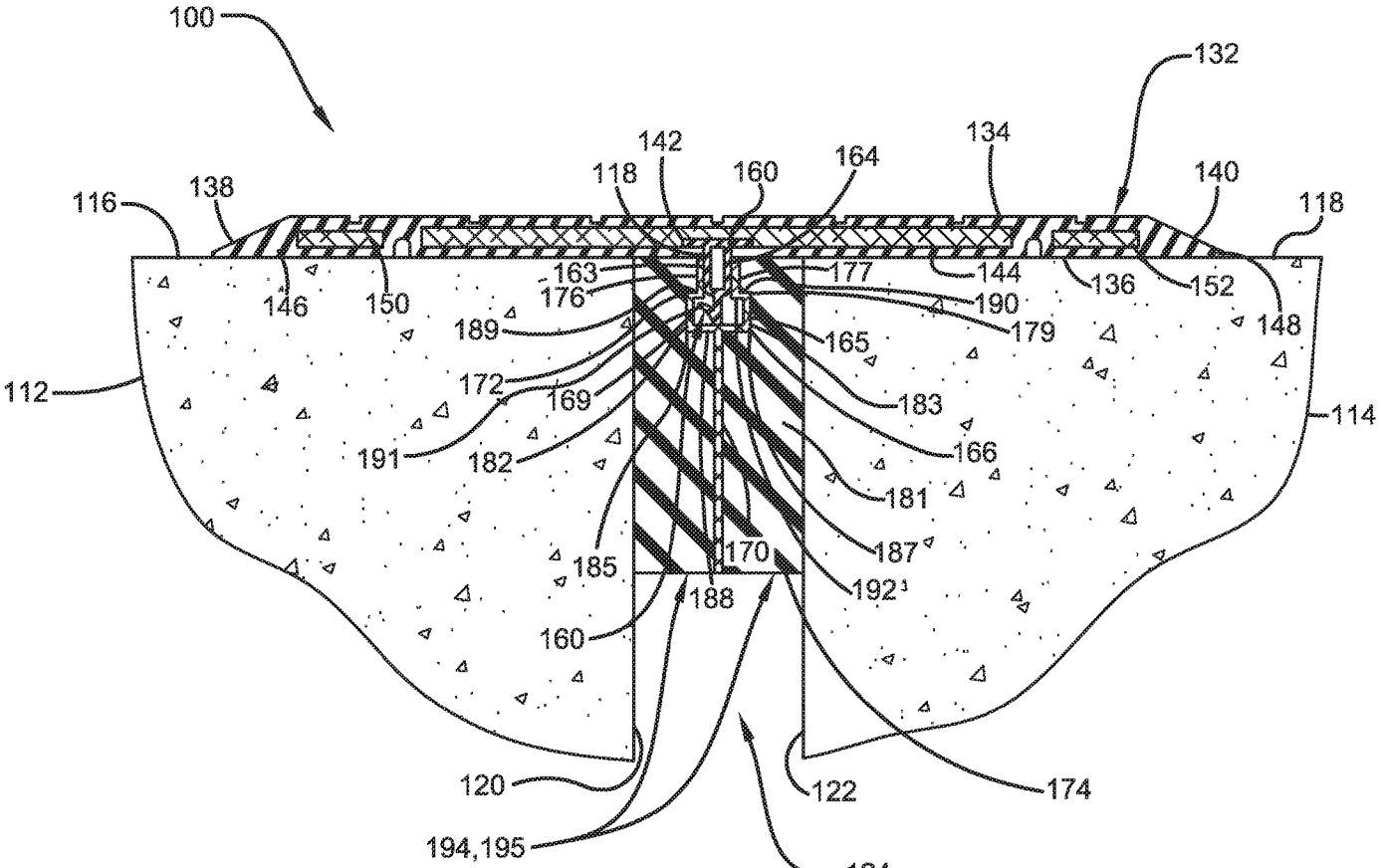
FIG.2 is a cross-sectional view of a second illustrative embodiment of the expansion joint sealing system.

FIG. 2 depicts a second illustrative embodiment of the expansion joint seal installed across an expansion joint having a gap or opening formed between two spaced-apart concrete structural members. The expansion joint 100 comprises two spaced-apart structural members 112, 114. Each of structural members 112, 114 includes horizontally extending top surfaces 116, 118 and vertically extending marginal side faces 120, 122. A gap or opening 124 is formed in the space between marginal side faces 120, 122 of spaced-apart structural members 112, 114. According to the second illustrative embodiment depicted in FIG. 2, the expansion joint seal 130 includes a horizontally extending rigid plastic coverplate 132 having opposite facing top 134 and bottom 136 surfaces, and incline planes 138, 140 located on opposite longitudinal sides of the coverplate 132 for promoting a smooth transition across the coverplate 132.

The coverplate 132 includes an elongated resilient cover 142 and at least one rigid plate 144 encapsulated by the cover 142. The coverplate 132 is positioned to overlie the gap 124 and to extend along opposite lateral sides of the gap 124 between the structural members 112, 114. The cover 142 may be in the form of a flexible, elastic strip like member having an upwardly directed load bearing face surface 134 with spaced apart upstanding ribs 146 arranged to extend transversely to the direction of traffic for improved traction. The opposite lateral terminal edges of the cover have tapered face surfaces for providing inclined planes 138, 140 for smoothing the transition from the traffic bearing face surface 134 of one of the structural members 112 and 114 to the coverplate 132 and then from the coverplate 132 to the traffic bearing face surface of adjoining one of the structural members 112 and 114. The cover 142 of the coverplate 132 includes thickened peripheral edges 146, 148 at opposite longitudinal sides of the cover 142.

The illustrative embodiment shown in FIG. 2 includes three spaced apart, substantially parallel, rigid plate members 144, 150, 152 that are encapsulated in the cover 142. The rigid plate member 144 is encapsulated in the cover 142 at a central position to overlie the gap 124 and forms a bridge to transfer the weight of pedestrian traffic to the structural members 112, 114. Parallel extending rigid plate members 150, 152 are encapsulated in the cover 142 at spaced-apart positions on each side of the central rigid plate member 144. The mass of the rigid plates 150, 152 help urge opposite longitudinal edges of the coverplate 132 toward the horizontally extending top surfaces of the spaced-apart structural members 112, 114. The rigid plate members 144, 150, 152 may be rolled steel, stainless steel, galvanized steel and aluminum plates. According to certain illustrative embodiments, at least one of the rigid plate members 14, 150, 152 are galvanized steel plates. According to other illustrative embodiments, each of the rigid plate members 140, 150, 152 are galvanized steel plates.

According to the embodiment of FIG. 2, a connector means 160 extends downwardly from the bottom surface 136 of the coverplate 132. As shown in FIG. 2, the connector comprises a snap-fit connector 160 that extends downwardly from the coverplate 132. The snap-fit connector 160 comprises a horizontally extending top wall 162, spaced-apart side walls 163, 164, a lower connecting segment 165 connecting said side walls 163, 164 together, and a tab 166 extending downwardly from said lower connecting segment 165 and having upper and lower ends 167, 168, said tab 166 comprising a flange 169 portion extending upwardly and outwardly from said lower end 168 of said tab 166. The horizontally extending top wall 162 of the snap-fit connector 160 is attached to the coverplate 132 by inserting the horizontally extending top wall 162 of the snap-fit connector 160 into the elastomeric cover 142 of the coverplate 132. As shown in FIG. 2, the insertion of the horizontally extending top wall 162 of the snap-fit connector 160 into the elastomeric cover 142 of the coverplate 132 forms a dovetail joint connection securing the snapfit connector 160 to the coverplate 132.

Still referring to FIG, 2, a central spine 170 connected to the coverplate 132 by the snap-fit connector 160 and extends downwardly from the connecting member 160. The central spine 170 comprises means for accepting 172 a portion of the snap-fit connector 160 and an elongated rib 174 extending downwardly from the means for accepting 172 the snap-fit connector 160. The means for accepting 172 the snap-fit connector 160 comprises an upper passageway 175 that is in communication a lower cavity 176. The upper passageway 175 is defined by spaced-apart vertical side walls 176, 177 and upper and lower ends 178, 179. The distance between the spaced-apart vertical side walls 176, 177 define a first width 180 of the upper passageway 175. The lower cavity portion 181 of the means for accepting 172 the snap-fit connector 160 comprises spaced-apart vertical side walls 182, 183 having upper and lower ends 184-187, a horizontal bottom wall 188 that are connected to the lower ends 185, 187 of the spaced-apart cavity side walls 182, 183, and horizontal top wall portions 189, 190 that are connected to the upper ends 184, 186 of the spaced-apart cavity side walls 182, 183. As described in greater detail below, the cavity top wall portions 189, 190 are connected to the lower ends 179 of the upper passageway side walls 176, 177, and the upper ends 184, 186 of the cavity side walls 182, 183, and form abutment surfaces 191, 192 for the snap-fit connector 160. The distance between the cavity side walls 182, 183 define a width 193 of the lower cavity 181 that is less than the greater than the width 180 of the upper passageway 175. Resilient foam seal sections 194, 195 are positioned on each side of the downwardly extending rib 174 of the central spine 170, and occupy the space between the opposite facing surfaces of the downwardly extending rib 174 and the marginal side wall faces 120, 122 of the spaced-apart structural members 112, 114. The snap-fit connector 160 is inserted into the upper passageway 175 of the means for accepting 172 of said central spine 170. The side walls 163, 164 of snap-fit connector 160 are in abutting contact with the side walls 176, 177 of the upper passageway 175 of the means for accepting 172 of the central spine 170. The tab 166 of the snap-fit connector 160 extends downwardly into the lower cavity 181 of the means for accepting 172 of the central spine 170. When the expansion joint seal is at "rest" with the bottom surface 136 of the coverplate 132 resting on the horizontally extending top surfaces 116, 118 of the spaced-apart structural members 112, 114, there is a clearance between the flange 169 of the tab 166 and the abutment surface 191. In the event of thermal cycling and/or seismic movement, the flange of the tab 169 would come into contact into abutting contact with abutment surface 191, thereby keeping the coverplate 132 positioned over the gap of the expansion joint and preventing it from being pulled out of the expansion joint.

Figure 3:
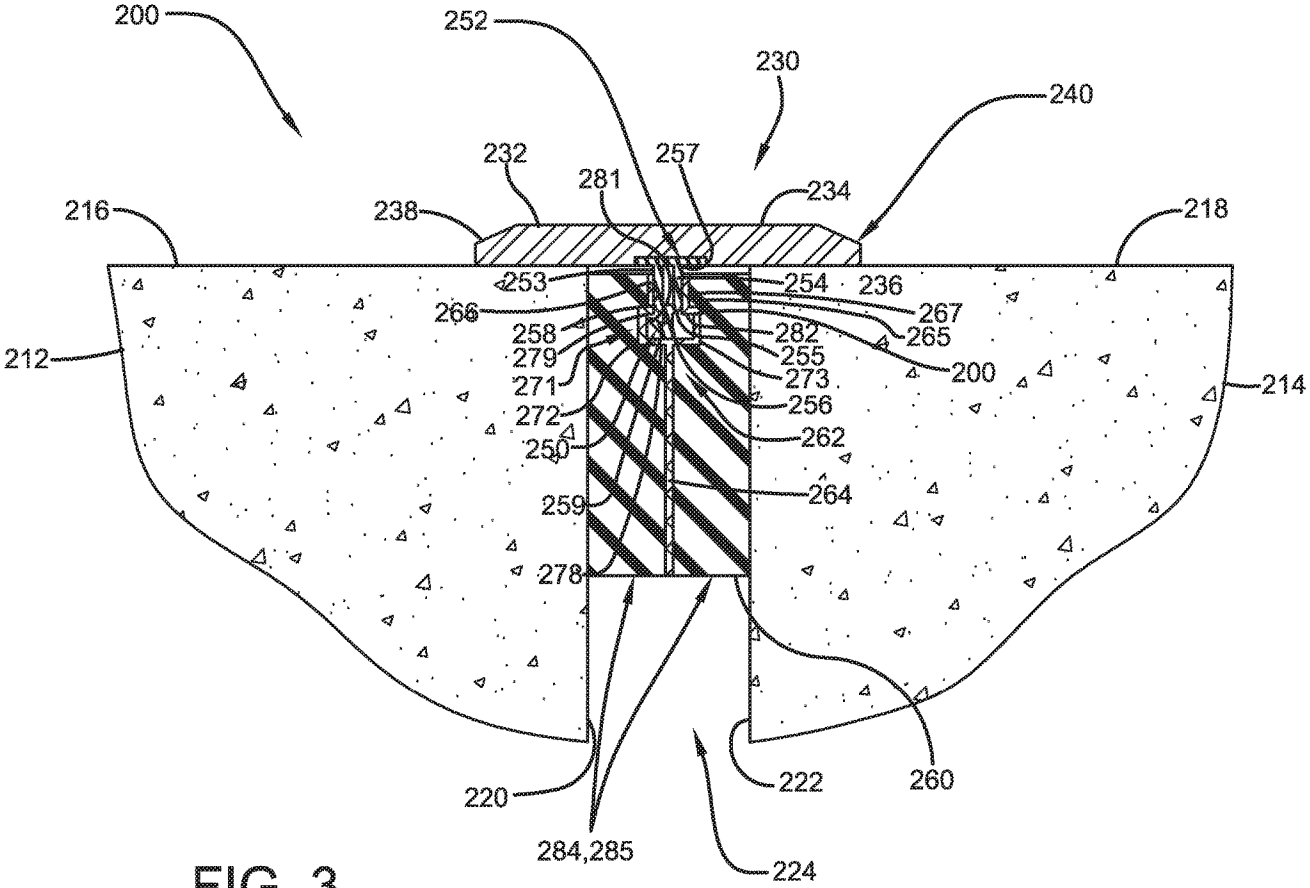
FIG. 3 is a cross-sectional view of a third illustrative embodiment of the expansion joint sealing system.

FIG. 3 depicts a first illustrative embodiment of the expansion joint seal installed across an expansion joint having a gap or opening formed between two spaced-apart concrete structural members. The expansion joint 200 comprises two spaced-apart structural members 212, 214. Each of structural members 212, 214 includes horizontally extending top surfaces 216, 218 and vertically extending marginal side faces 220, 222. A gap or opening 224 is formed in the space between marginal side faces 220, 222 of spaced-apart structural members 212, 214. According to the third illustrative embodiment depicted in FIG. 3, the expansion joint seal 230 includes a horizontally extending rigid plastic coverplate 232 having opposite facing top 234 and bottom 236 surfaces, and incline planes 238, 240 located on opposite longitudinal sides of the coverplate 232 for promoting a smooth transition across the coverplate 232. Coverplate 232 also includes a desired thickness 242 extending between the top 234 and bottom 236 surfaces. According to the embodiment of FIG. 3, a connector means 250 extends downwardly from the bottom surface 236 of the coverplate 232.

As shown in FIG. 3, the connector comprises a snap-fit connector 250 that extends downwardly from the coverplate 232. The snap-fit connector 250 comprises a horizontally extending top wall 252, spaced-apart side walls 253, 254, a lower connecting segment 255 extending between side walls 253, 254, and a tab 256 extending downwardly from said lower connecting segment 255 and having upper and lower ends 257, 258, said tab 256 comprising a flange 259 portion extending upwardly and outwardly from said lower end 258 of said tab 256. The horizontally extending top wall 252 of the snap-fit connector 250 is attached to the coverplate 232 by inserting the horizontally extending top wall 252 of the snap-fit connector 250 into the bottom surface 236 of the coverplate 232. As shown in FIG. 3, the insertion of the horizontally extending top wall 252 of the snap-fit connector 250 into the cover 232 of the coverplate 232 forms a dovetail joint connection securing the snap-fit connector 250 to the coverplate 232.

Still referring to FIG. 3, a central spine 260 connected to the coverplate 232 by the snap-fit connector 250 and extends downwardly from the connecting member 250. The central spine 260 comprises means for accepting 262 a portion of the snap-fit connector 250 and an elongated rib 264 extending downwardly from the means for accepting 262 the snap-fit connector 250. The means for accepting 262 the snap-fit connector 250 comprises an upper passageway 265 that is in communication a lower cavity 266. The upper passageway 265 is defined by spaced-apart vertical side walls 266, 267 and upper and lower ends 268, 269. The distance between the spaced-apart vertical side walls 266, 267 define a first width 270 of the upper passageway 265. The lower cavity portion 271 of the means for accepting 262 the snap-fit connector 250 comprises spaced-apart vertical side walls 272, 273 having upper and lower ends 274-277, a horizontal bottom wall 278 that are connected to the lower ends 275, 277 of the spaced-apart cavity side walls 272, 273, and horizontal top wall portions 279, 280 that are connected to the upper ends 274, 276 of the spaced-apart cavity side walls 272, 273. As described in greater detail below, the cavity top wall portions 279, 280 are connected to the lower ends 269 of said upper passageway side walls 266, 267, and the upper ends 274, 276 of cavity side walls 272, 273, and form abutment surfaces 281, 282 for the snap-fit connector 250. The distance between the cavity side walls 272, 273 define a width 283 of the lower cavity 271 that is less than the greater than the width 270 of the upper passageway 265. Resilient foam seal sections 284, 285 are positioned on each side of the downwardly extending rib 264 of the central spine 260, and occupy the space between the opposite facing surfaces of the downwardly extending rib 264 and the marginal side wall faces 220, 222 of the spaced-apart structural members 212, 214. The snap-fit connector 250 is inserted into the upper passageway 265 of the means for accepting 262 of said central spine 260. The side walls 253, 254 of snap-fit connector 250 are in abutting contact with the side walls 266, 267 of the upper passageway 265 of the means for accepting 262 of the central spine 260. The tab 256 of the snap-fit connector 250 extends downwardly into the lower cavity 271 of the means for accepting 262 of the central spine 260. When the expansion joint seal is at "rest" with the bottom surface 236 of the metal coverplate 232 resting on the horizontally extending top surfaces 216, 218 of the spaced-apart structural members 212, 214, there is a clearance between the flange 259 of the tab 256 and the abutment surface 281. In the event of thermal cycling and/or seismic movement, the flange of the tab 259 would contact into abutting contact with abutment surface 281, thereby keeping the coverplate 232 positioned over the gap of the expansion joint and preventing it from being pulled out of the expansion joint.

Figure 6:
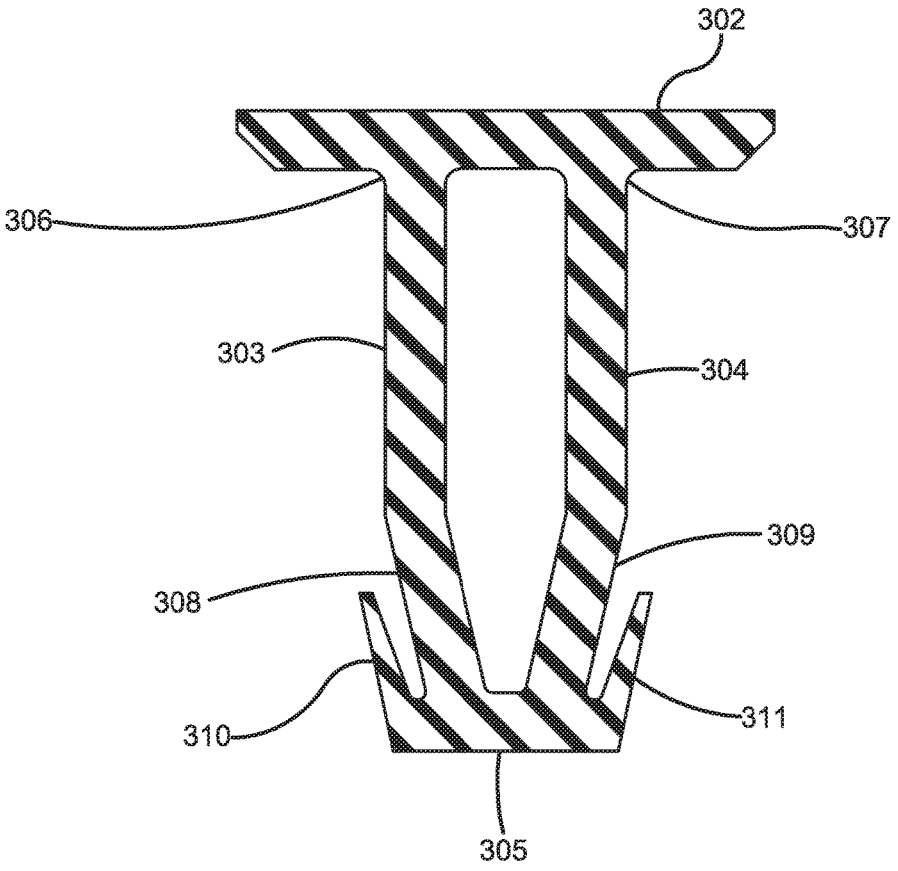
FIG. 6 is a cross-sectional view of another illustrative embodiment of the snap-fit connector.

Another illustrative embodiment of the snap-fit connector is shown in FIG.6. As shown in FIG. 6, the snap-fit connector 300 comprises a horizontally extending top wall 302, spaced-apart side walls 303, 304, and a lower connecting segment 305 extending between the side walls 303, 304. Each of side walls 303, 304 includes upper and lower ends 306-309. The side walls 303, 304 extend downwardly in a substantially perpendicular manner in relation to the bottom surface of the horizontally extending top wall 302 of the connector 300. The side walls 303, 304 extend in a substantially parallel fashion to one another. Near their respective lower ends 308, 309, side walls 303, 304 are angled inwardly toward each other. Flange members 310, 311 extend upwardly and outwardly from the lower segment 305 of the connector 300. Flange members 310, 311 may extend upwardly and outwardly from the lower connecting segment 305 in a manner that is also substantially parallel to the angled lower portions of the side walls 303, 304.

Figure 7:
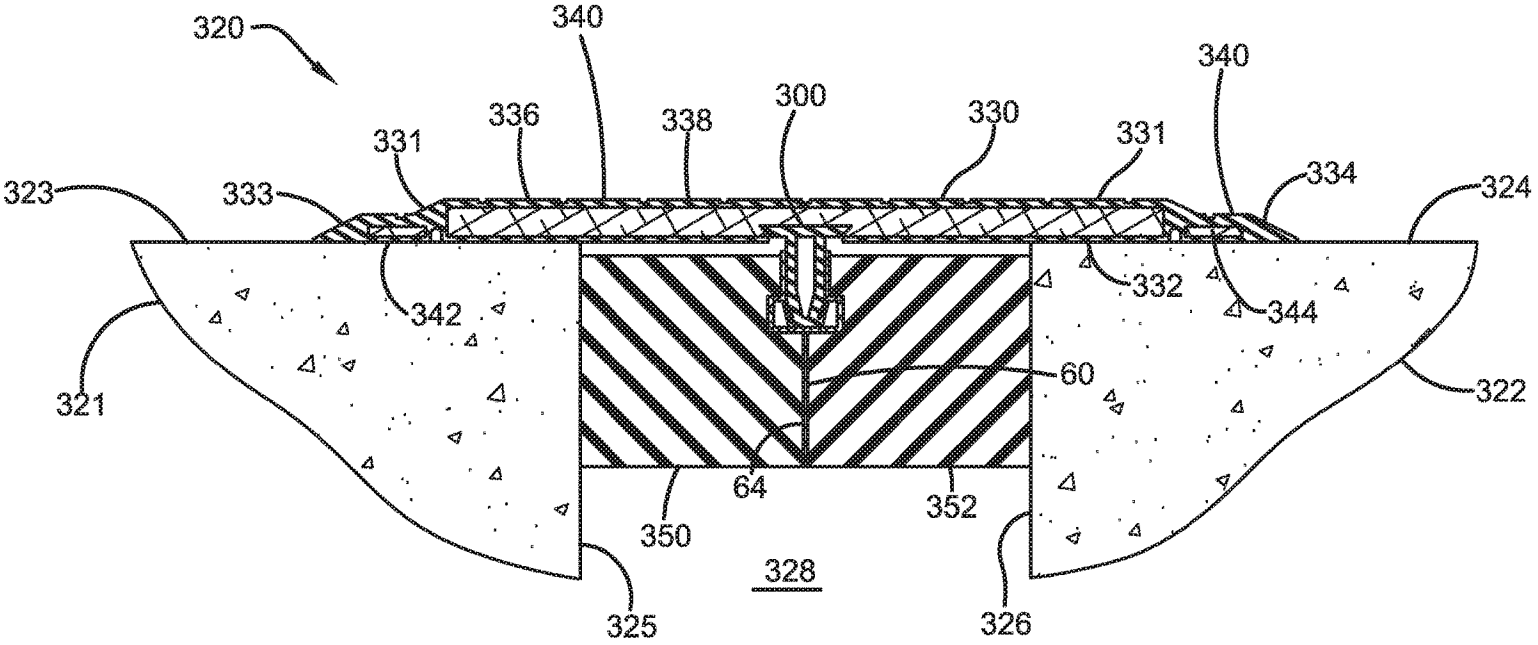
FIG. 7 is a cross-sectional view of fourth illustrative embodiment of the expansion joint sealing system.

FIG. 7 shows a fourth illustrative embodiment of the expansion joint seal, which incorporates the snap-fit connector of FIG. 6. The expansion joint seal 320 is installed across an expansion joint having a gap or opening formed between two spaced-apart concrete structural members. The expansion joint 320 comprises two spaced-apart structural members 321, 322 Each of structural members 321, 322 includes horizontally extending top surfaces 323, 324 and vertically extending marginal side faces 325, 326. A gap or opening 328 is formed in the space between marginal side faces 325, 326 of spaced-apart structural members 321, 322. According to the illustrative embodiment depicted in FIG. 7, the expansion joint seal 320 includes a horizontally extending rigid plastic coverplate 330 having opposite facing top 331 and bottom 332 surfaces, and incline planes 333, 334 located on opposite longitudinal sides of the coverplate 330 for promoting a smooth transition across the coverplate 330.

The coverplate 330 includes an elongated resilient cover 336 and at least one rigid plate 338 encapsulated by the cover 336. The coverplate 320 is positioned to overlie the gap 328 and to extend along opposite lateral sides of the gap 328 between the structural members 321, 322. The cover 336 may be in the form of a flexible, elastic strip like member having an upwardly directed load bearing face surface 331 with spaced apart upstanding ribs 340 arranged to extend transversely to the direction of traffic for improved traction. The opposite lateral terminal edges of the cover have tapered face surfaces for providing inclined planes 333, 334 for smoothing the transition from the traffic bearing face surface 331 of one of the structural members 321 and 322 to the coverplate 330 and then from the coverplate 330 to the traffic bearing face surface of adjoining one of the structural members 321, 322. The cover 336 of the coverplate 330 includes thickened peripheral edges 339, 340 at opposite longitudinal sides of the cover 336.

The illustrative embodiment shown in FIG. 7 includes three spaced apart, substantially parallel, rigid plate members 338, 342, 344 that are encapsulated in the cover 336. The rigid plate member 338 is encapsulated in the cover 336 at a central position to overlie the gap 328 and forms a bridge to transfer the weight of pedestrian traffic to the structural members 321, 322. Parallel extending rigid plate members 342, 344 are encapsulated in the cover 336 at spaced-apart positions on each side of the central rigid plate member 338. The mass of the rigid plates 342, 344 help urge opposite longitudinal edges of the coverplate 330 toward the horizontally extending top surfaces of the spaced-apart structural members 321, 322.

According to the embodiment of FIG. 7, a connector 300 (of FIG. 6) extends downwardly from the bottom surface 332 of the coverplate 330. As shown in FIG. 7, the connector comprises a snap-fit connector 300 that extends downwardly from the coverplate 330. The horizontally extending top wall 302 of the snap-fit connector 300 is attached to the coverplate 330 by inserting the horizontally extending top wall 302 of the snap-fit connector 300 into the elastomeric cover 336 of the coverplate 330. As shown in FIG. 7, the insertion of the horizontally extending top wall 302 of the snap-fit connector 300 into the elastomeric cover 336 of the coverplate 330 forms a dovetail joint connection with the coverplate 330 (via the cover 336 and/or central rigid plate 338) securing the snapfit connector 300 to the coverplate 330.

Still referring to FIG. 7, a central spine 60 (of FIG. 5) is connected to the coverplate 330 by the snap-fit connector 330 and extends downwardly from the connecting member 300. Resilient foam seal sections 350, 352 are positioned on each side of the downwardly extending rib 64 of the central spine 60, and occupy the space between the opposite facing surfaces of the downwardly extending rib 64 and the marginal side wall faces 325, 326 of the spaced-apart structural members 321, 322. The snap-fit connector 300 is inserted into the upper passageway 65 of the means for accepting 62 of said central spine 60. The side walls of snap-fit connector 300 are in abutting contact with the side walls of the upper passageway 65 of the means for accepting 62 of the central spine 60. The angled lower ends 308, 309 and flanges 310, 311 of the snap-fit connector 300 extend downwardly into the lower cavity 71 of the means for accepting 62 of the central spine 60. Portions of the flanges 310, 311 are in abutting contact with the abutment surfaces 81, 82 of the top wall portions 79, 80 of the lower cavity 71 of the means for accepting 62 of the central spine 60. The abutting contact of the flanges 310, 311 with the abutment surfaces 81, 82 form an interference which prevents the cover plate 330 from disengaging with from the expansion joint seal 320 in response to movement in joint gap.

Figure 8B:
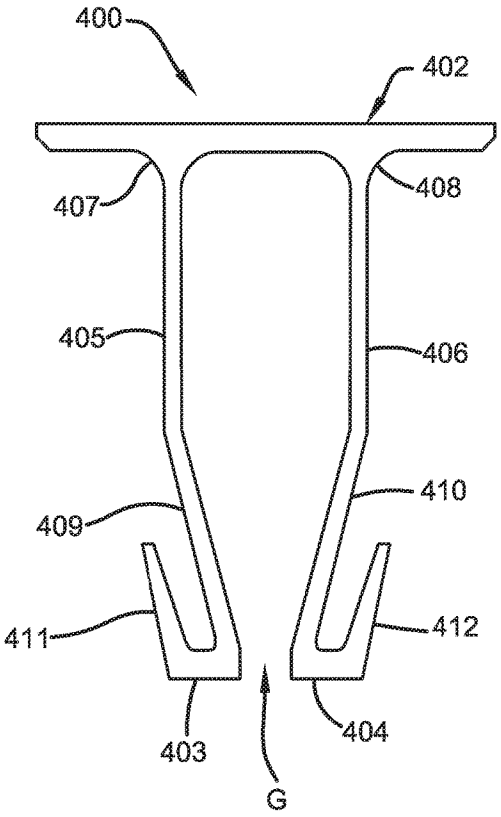
FIG. 8B is an end view of the illustrative embodiment of the snap-fit connector of the expansion joint system shown in FIG. 8A.
Figure 8A:
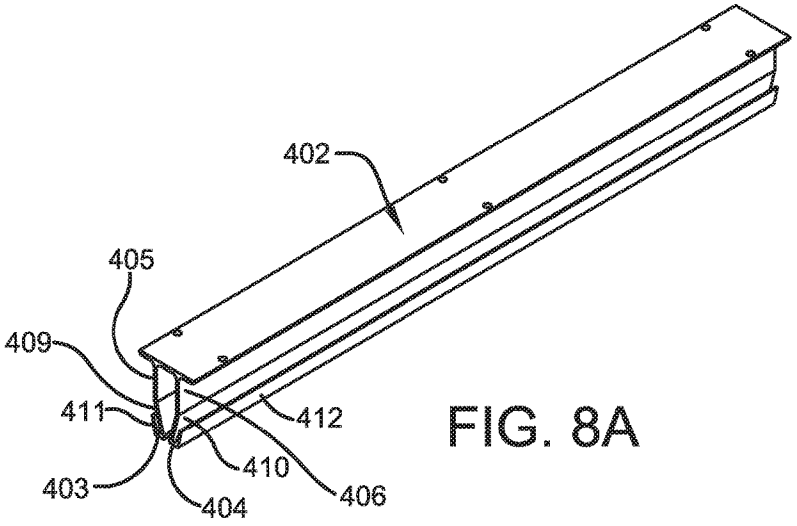
FIG. 8A is an axonometric view of another illustrative embodiment of the snap-fit connector of the expansion joint system.

FIGS. 8A and 8B show another illustrative embodiment of the snap-fit connector 400 of the expansion joint system. As shown in FIGS. 8A and 8B, the snap-fit connector 400 comprises a horizontally extending top wall 402, spaced-apart side walls 405, 406 and a gap G located between the lower ends of the side walls 405, 406. Each of side walls 405, 406 includes upper and lower ends 407-410. The side walls 405, 406 extend downwardly in a substantially perpendicular manner in relation to the bottom surface of the horizontally extending top wall 402 of the connector 400. The side walls 405, 406 extend in a substantially parallel fashion to one another. Near their respective lower ends 409, 410 side walls 405, 406 are angled inwardly d each other. The lower angled ends 409, 410 terminate in bottom walls 403, 404, respectively. There is a gap G located between the bottom walls 403, 404. Bottom walls 403, 404 extend horizontally. Bottom walls 403, 404 may also extend substantially parallel to the top wall 402. Flange members 411, 412 extend upwardly and outwardly from the ends of the bottom walls 403, 404 of the connector 400. Flange members 411, 412 may extend upwardly and outwardly from the ends of the bottom walls 403, 404 in a manner that is also substantially parallel to the angled lower portions of the side walls 409, 410.

Figure 9B:
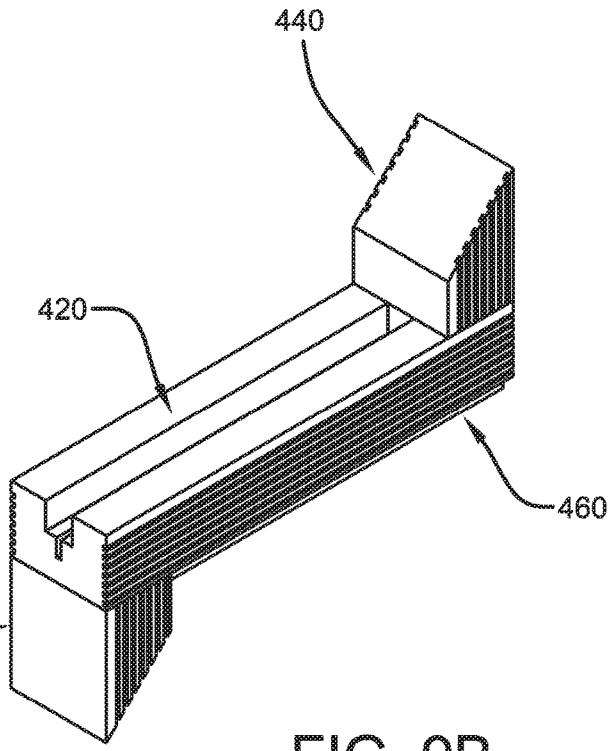
FIG. 9B is an axonometric view of illustrative foam seal members of the expansion joint system shown in FIG. 9A.
Figure 9A:
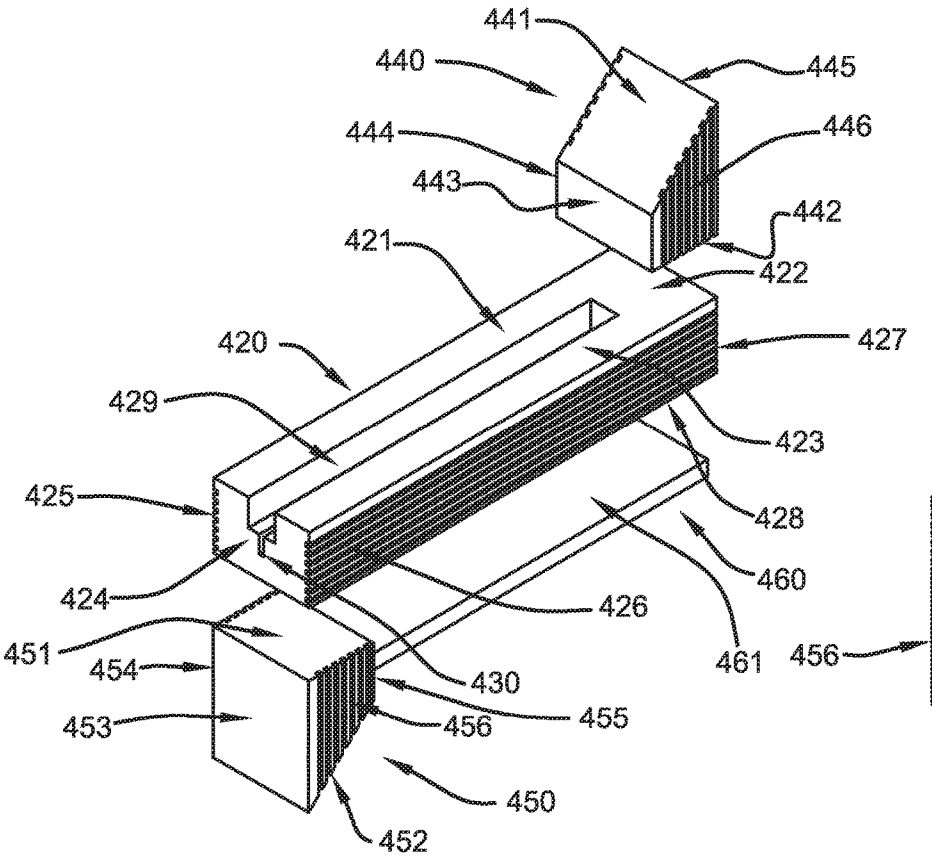
FIG. 9A is an exploded axonometric view of illustrative foam seal members of the expansion joint system.

FIGS. 9A and 9B show the illustrative foam seal members of the expansion joint system. The expansion joint system includes foam members 420, 440, 450 and 460. Foam section 420 is the tread foam member that is adapted to be positioned in an expansion joint gap located between two structural members forming a tread portion of a tread-riser structure. Foam members 440 and 450 are riser foam sections that are adapted to be positioned in an expansion joint gap located between two structural members forming riser portions of a tread-riser structure. Foam member 460 is a foam member that is adapted to support tread foam member 420.

Still referring to FIGS. 9A and 9B, foam member 420 includes a top surface comprising foam areas 421, 422, 423. Foam member 420 has a bottom surface 428 opposite the top surface. The tread foam member further includes front wall 24, side walls 425, 426, and rear wall 427. Tread foam areas 421, 422, 423 together form a substantially U-shaped profile having a trough 429 when view from a top view. Tread foam member 420 further includes a longitudinal slit or groove 430 formed in the bottom of the trough 429. The groove 430 extends partially through the thickness of the foam member 420, but does not extend through the bottom wall 428 of the member 420. The groove 430 is substantially parallel to the side walls 426, 426 of the foam member 420.

Still referring to FIGS. 9A and 9B, foam member 440 includes an angled or otherwise tapered top surface 441. Foam member 440 has a bottom surface 442. The foam member 440 further includes front wall 443, side walls 444, 446 and rear wall 445. Bottom surface 442 of riser foam member 440 is adapted to be positioned in adjacent bonded contact with the top surface of tread foam member 420 near foam area 422 of member 420.

Still referring to FIGS. 9A and 9B, foam member 450 includes top surface 451. Foam member 450 also includes an angled or otherwise tapered bottom surface 452, side walls 454, 456, front wall 453, and rear wall 455. Top surface 451 of riser foam member 450 is adapted to be positioned in adjacent bonded contact with the bottom surface 428 of tread foam member 420 near the front end of member 420.

Side walls 425, 426 of the foam member 420 also include spaced-apart ribs extending outwardly from the surface of each of side walls 425, 426. Side walls 444, 446 of foam member 440 also include spaced-apart ribs extending outwardly from the surface of each of side walls 444, 446. Side walls 454, 456 of foam member 450 also include spaced-apart ribs extending outwardly from the surface of each of side walls 454, 456. The ribs are adapted to engage and hold an adhesive material to assist in the bonding of the foam members 420, 440, 450 to the surfaces of the spaced-apart structural members of the expansion joint.

Lower foam member 460 is adapted to be positioned adjacent the bottom surface 428 of tread foam member 420. Foam member 460 is bonded to the bottom surface of a portion of tread foam 428. Foam member 460 is a stiffer foam as compared to foam 420 and is intended to support foam member 420.

Figure 10:
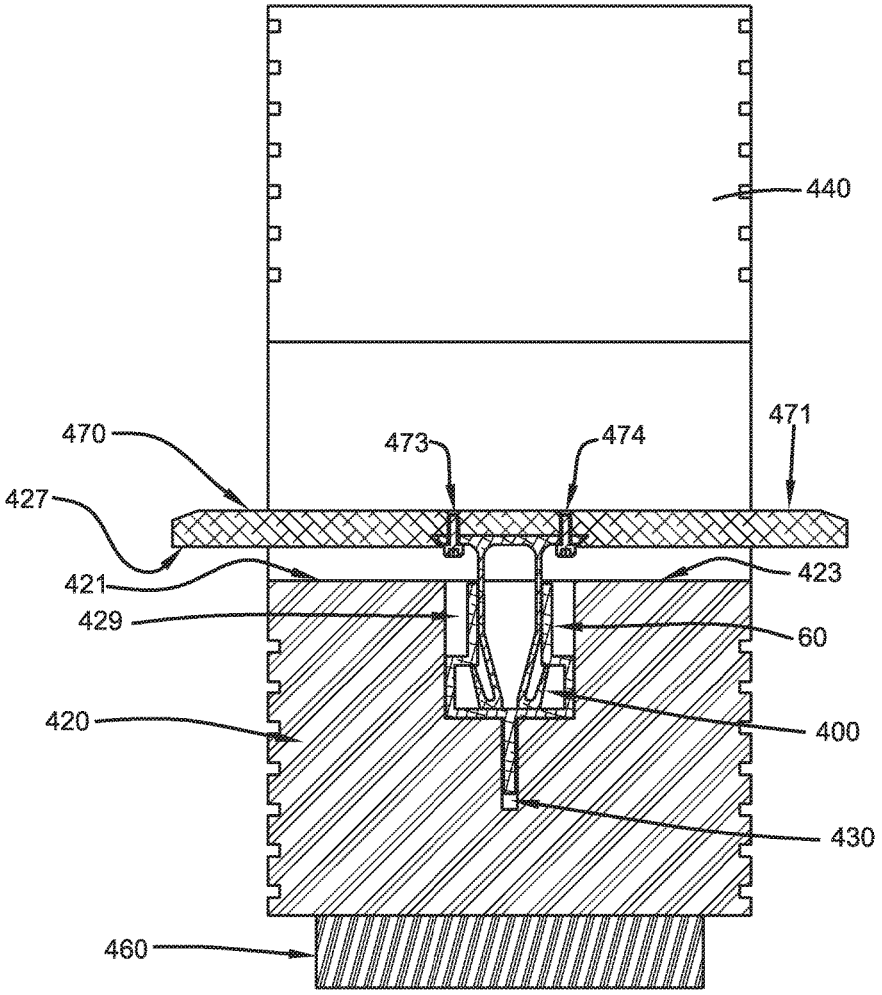
FIG. 10 is a cross section view of an illustrative embodiment of the expansion joint system incorporating the illustrative snap-fit connector of FIGS. 8A and 8B.

FIG. 10 shows a cross section view of an illustrative embodiment of the expansion joint system incorporating the illustrative snap-fit connector of FIGS. 8A and 8B. The expansion joint system includes a cover plate 470 having opposite facing top 471 and bottom 472 surfaces, snap-fit connector 400, central spine 60, tread foam 420 and riser foam 440. Tread foam 420 is shown bonded to lower foam member 460. Central spine 60 is shown inserted into longitudinal groove 430 of trough 429 of foam member 420. Snap-fit connector 400 is shown engaged in the locked position with the central spine 60. The top horizontal wall 402 of snap-fit connector is connected to the bottom surface 472 of cover plate 470 with mechanical fasteners 473, 474.

Figure 11B:
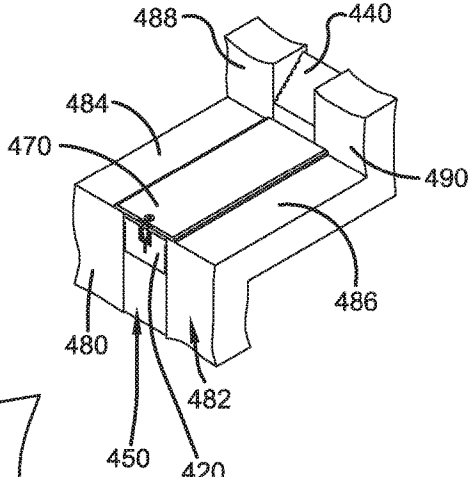
FIG. 11B is an axonometric view of an illustrative embodiment of the expansion joint shown in FIG. 11A.
Figure 11A:
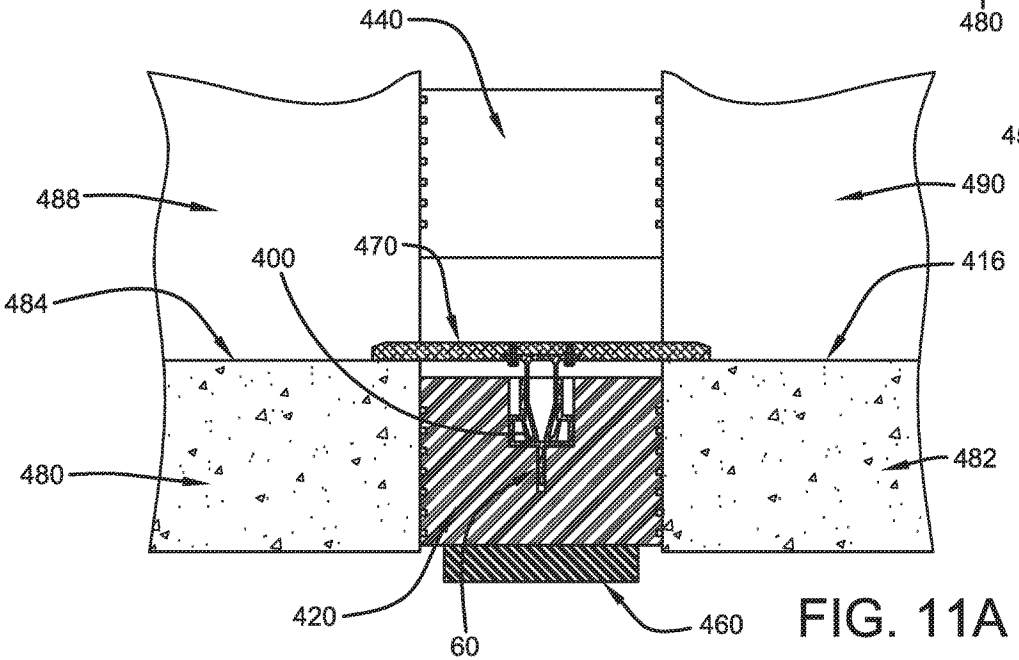
FIG. 11A is a cross section view of an illustrative embodiment of the expansion joint incorporating the illustrative expansion joint system shown in FIG. 10.

FIGS. 11A and 11B show an illustrative embodiment of the expansion joint incorporating the illustrative expansion joint system shown in FIG. 10. The expansion joint includes spaced-apart riser structural members 480, 482, tread structural members 484, 486, and riser structural members 488, 490. The expansion joint sealing system bridges the gap between the tread-riser structural members. The expansion joint system includes a cover plate 470, snap-fit connector 400 connected to the cover plate and depending downwardly from the bottom surface of the cover plate 470, central spine 60, tread foam 420 and riser foam members 440, 450. Tread foam 420 is shown bonded to lower foam member 460. Central spine 60 is shown inserted into longitudinal groove 430 of trough 429 of foam member 420. Snap-fit connector 400 is shown engaged in the locked position with the central spine 60. The top horizontal wall 402 of snap-fit connector is connected to the bottom surface 472 of cover plate 470 with mechanical fasteners. Cover plate 470 bridges the gap between tread structural members 484, 486. Riser foam member 440 fills the gap between spaced-apart riser structural members 484, 490. Riser foam member 450 fills the gap between spaced-apart riser structural members 480, 482.

Figure 12B:
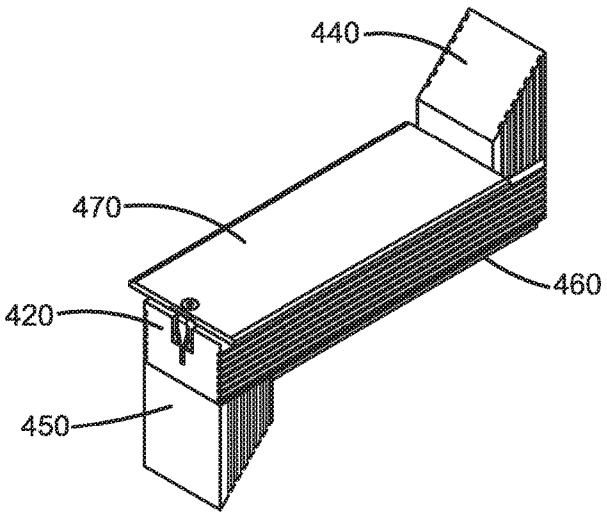
FIG. 12B is an axonometric view of the illustrative embodiment of the expansion joint expansion joint system shown in FIG. 12A.
Figure 12A:
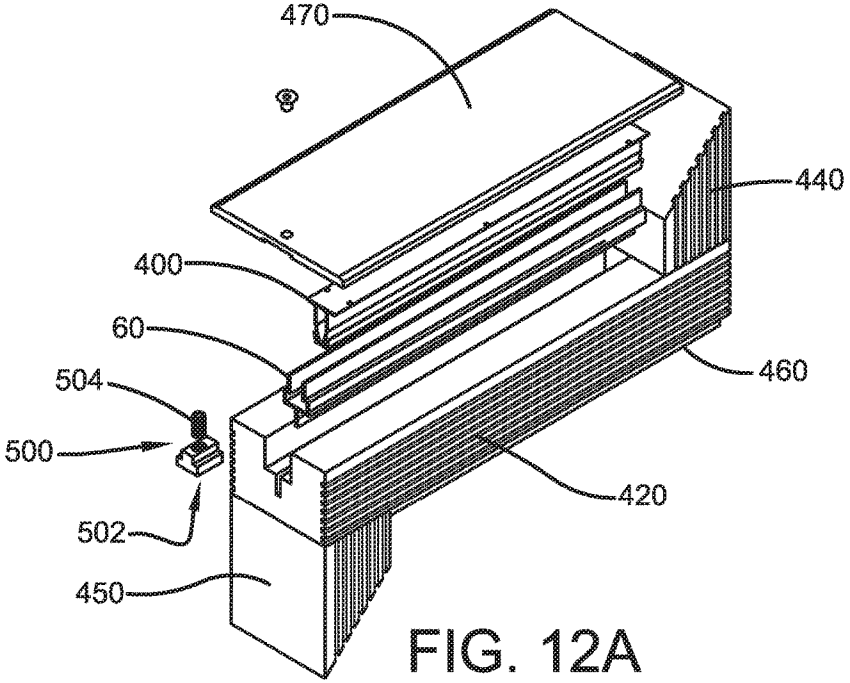
FIG. 12A is an exploded axonometric view of an illustrative embodiment of the expansion joint expansion joint system shown in FIG. 10.

FIGS. 12A and 12B show the illustrative embodiment of the expansion joint system shown in FIG. 10. The expansion joint system includes a cover plate 470, snap-fit connector 400, a central spine 60 for receiving the snap-fit connector 400, tread foam 420 and riser foam members 440, 450. Tread foam 420 is shown bonded to lower foam member 460. The system further includes a stop member 500 for preventing undesired movement of the central spine 60 and snap-fit connector 400. Stop member 500 includes a T-shaped base member 502 and a thread screw 504. Threaded screw 504 is engaged with T-shaped base 502 through a cooperating internally threaded receptacle.

Figure 13:
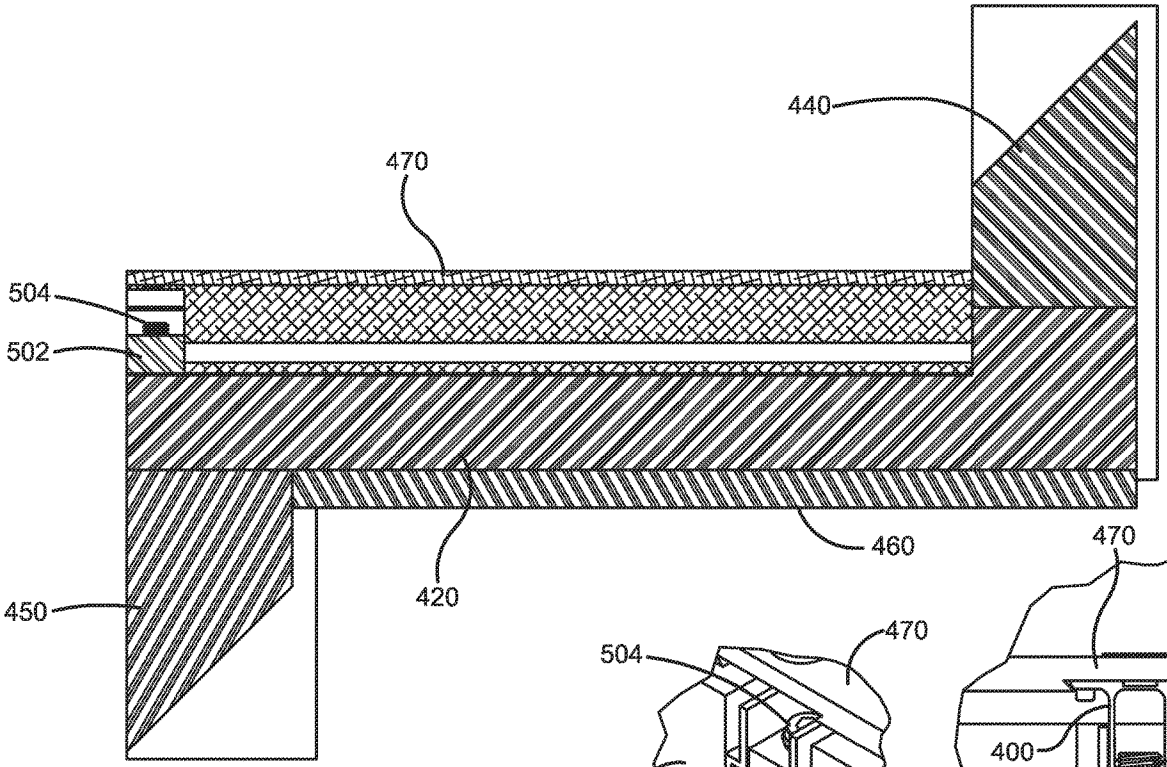
FIG. 13 is a longitudinal cross section view of the illustrative expansion joint system of FIGS. 12A and 12B.
Figure 14A:
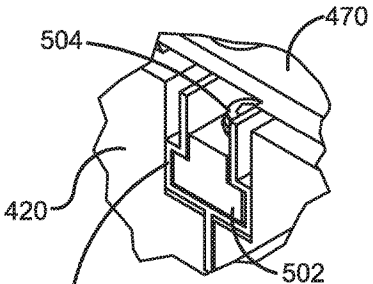
FIG. 14A is a fragmentary axonometric view of an illustrative stop member of the expansion joint system.
Figure 14B:
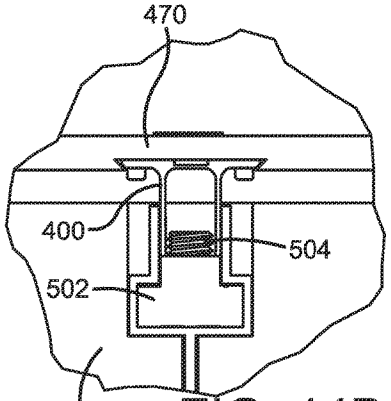
FIG. 14B is an end view of the illustrative stop member of the expansion joint system shown in FIG. 14A.

FIGS. 13, 14A and 14B show the expansion joint system and detail of stop member 500. Central spine 60 is inserted into groove 429 of tread foam member 420. Snap-fit connector 400 is fastened to the cover plate 470 with mechanical fasteners. Snap-fit connector is engaged in the locked position with the central spine 60. The T-shaped stop member 500 includes an exterior shape to be inserted into the central spine 60. The T-shaped stop member 500 includes horizontally extending shoulders adapted to abut against abutment surfaces of the central spine 60 to prevent undesired longitudinal movement of the snap-fit connector 400. As the treaded screw 504 is rotated, then T-shaped member 502 is locked into position within the central spine 60.

Figure 15B:
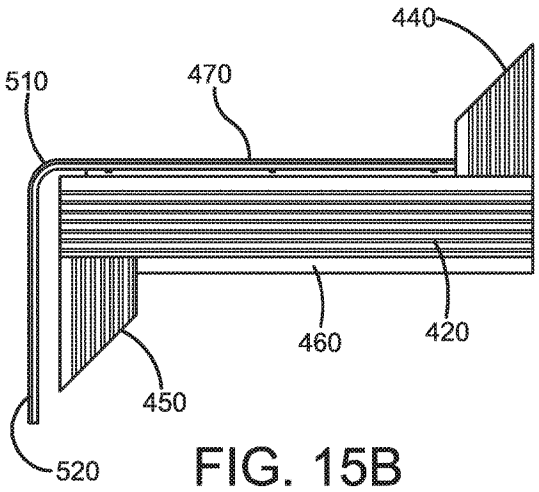
FIGS. 15A and 15B are an axonometric and side views of embodiments of the sealed expansion joint system.
Figure 15A:
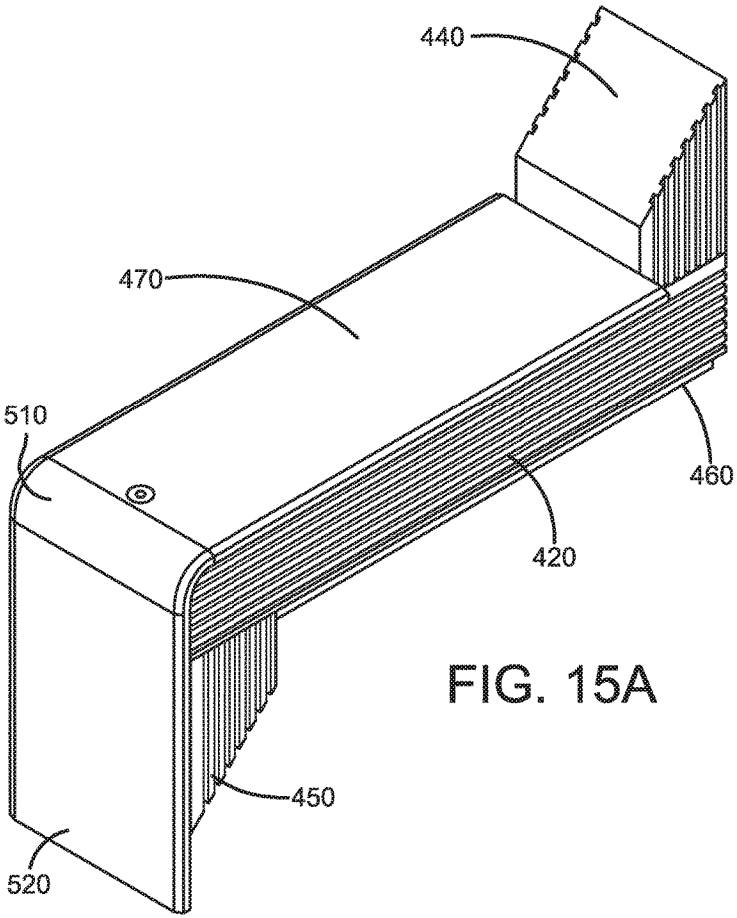
Figure 16B:
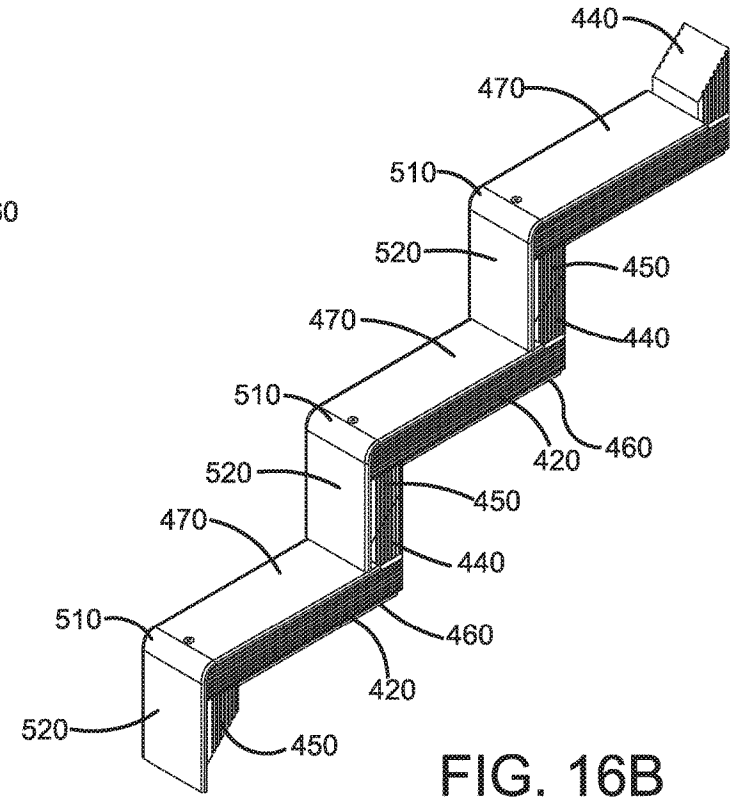
Figure 16A:
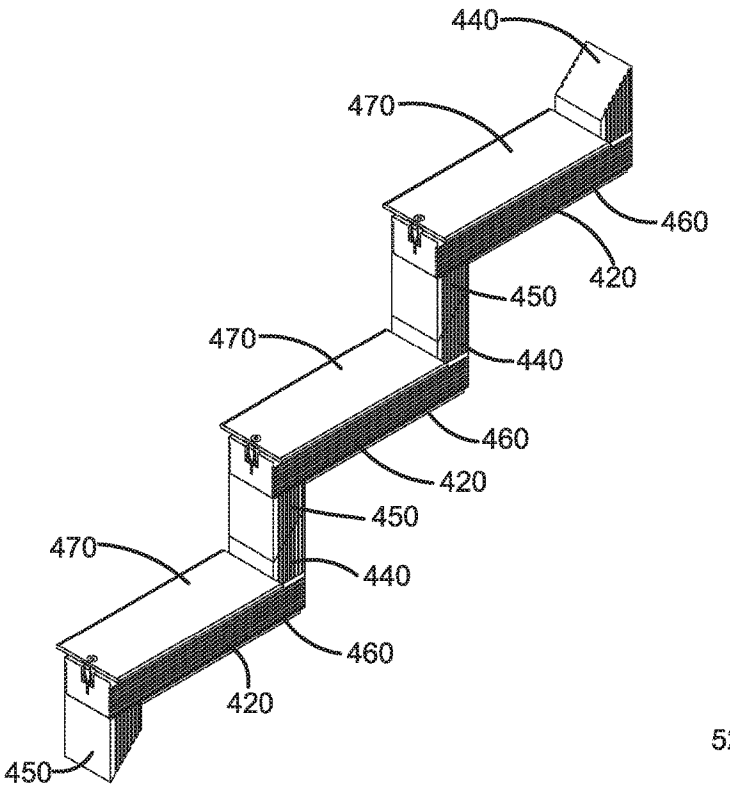

FIGS. 15A, 15B, 16A and 16B show the expansion joint system in a fully assembled state, but not positioned within the expansion joint gap. As shown in FIGS. 15A, 15B and 16A and he expansion joint system includes cover plates 470 and 520. Curved covered plate 510 provides a continuous smooth transition between cover plates 470 and 520. As shown in the embodiment of FIG. 16A, the system does not need to include curved plate 510. According to this embodiment, cover pates 470 and 520 are engaged to form a substantially 90° angle.

While the expansion joint seal disclosed herein is suitable for placement across a gap created by two spaced-apart structural members in sports stadiums having tread and riser portions, it should be noted that the seal is not limited to placement across a gap or opening in such expansion joint. To the contrary, the seal can be used to bridge an opening or gap between any two structural members to create a smooth traffic transition between the two structural members. Embodiments of the seal may be useful to bridge an opening or gap between vertically offset structural members. For example, the seal may be used to bridge structural members, such as concrete slabs, which are designed to be vertically offset or that may become vertically offset or displaced due to differential concrete settlement.

The use of the foam seal as an elastic recovery or return force mechanism has the dual advantage that the seal can remain watertight immediately below the level of the coverplate while at the same time the foam seal acts as the return force or stabilizing element for the cover plate to keep the coverplate positioned in the "neutral" or centered position.

The use of the closed cell foam seal or impregnated open cell foam provides a water resistant seal for the expansion joint in the area below the coverplate. The use of the foam seal also provides a self-centering mechanism for the coverplate of the seal to keep it positioned centrally across the expansion joint gap. The foam seal is resilient and has the property of being compressible and expandable. The ability of the foam seal to compress in response to the application of a force, and to expand to its original state prior to compression upon removing the force permits the system to self-center the coverplate over the expansion joint gap. For example, for any given expansion joint gap width, in the absence of movement, the coverplate will be position in a central or neutral position. In response to movement in the expansion joint gap, the width of the gap will become larger or smaller. In the situation where the width of the expansion joint gap becomes smaller in response to movement, then the foam seal will be compressed to the same degree on each side of the central spine. Even though the foam seal is compressed, an equilibrium will be reached on each side of the central spine and the coverplate will remain in a central or neutral position across the expansion joint gap. Likewise, in the situation where the width of the expansion joint gap becomes larger in response to movement, then the foam seal will expand to the same degree on each side of the central spine. Even though the foam seal has expanded, an equilibrium will be reached on each side of the central spine and the coverplate will remain in a central or neutral position across the expansion joint gap. Thus, expansion joint seal system is in equilibrium if the expansion force of the foam seal positioned on one side of the central spine is equal or equivalent to the expansion force of the foam seal positioned on the other side of the central spine.

According to certain embodiments, the watertight properties of the foam seal may be enhanced by applying a further sealant or sealer coating to the top surface(s) of the foam seal near the coverplate. According to certain embodiments, self-leveling water resistant sealants may be used. According to certain embodiments, the self-leveling water resistant sealant may comprise a silicone sealant.

While the expansion joint seal and expansion joint incorporating the expansion joint seal have been described in connection with the preferred embodiments, as shown in the various figures, it is to be understood that other similar embodiments may be used or modifications and additions may be made to the described embodiment for performing the same function of the seal and joint without deviating therefrom. Therefore, the expansion joint seal and expansion joint should not be limited to any single embodiment, but rather construed in breadth and scope in accordance with the recitation of the appended claims.

The invention claimed is:

1. An expansion joint seal comprising:

a coverplate, wherein said coverplate comprises a metal or metal alloy;

a snap-fit connector depending downwardly from said coverplate, wherein said snap-fit connecter is connected to said coverplate by a dovetail joint;

a central spine connected to said coverplate by said snap-fit connector and extending downwardly from a connecting portion; and at least one piece of expandable and compressible foam seal engaged with said central spine.

2. The expansion joint seal of claim 1, wherein said foam seal comprises an impregnated open cell foam.

3. The expansion joint seal of claim 1, wherein said coverplate comprises a rigid plastic material.

4. The expansion joint seal of claim 3, wherein said snap-fit connector comprises a rigid plastic material.

5. The expansion joint seal of claim 4, wherein said snap-fit connector is bonded to said coverplate.

6. The expansion joint seal of claim 4, wherein coverplate and said snap-fit connecter comprise a single extruded integral piece.

7. The expansion joint seal of claim 1, wherein said coverplate comprises an elastomeric material.

8. The expansion joint seal of claim 1, wherein said central spine comprises a metal, metal alloy, plastic, or composite material.

9. The expansion joint seal of claim 8, wherein said central spine comprises a metal.

10. The expansion joint seal of claim 1, wherein said central spine comprises means for accepting a portion of said snap-fit connector and an elongated rib extending downwardly from said means for accepting.

11. The expansion joint seal of claim 10, wherein said means for accepting comprises an upper passageway in communication a lower cavity, wherein said upper passageway has a width that is less than the width of the lower cavity.

12. The expansion joint seal of claim 11, wherein said upper passageway is defined by spaced-apart vertical side walls and upper and lower ends.

13. The expansion joint seal of claim 12, wherein said lower cavity comprises spaced-apart vertical side walls having upper and lower ends, a horizontal bottom wall connected to said lower ends of said spaced-apart cavity side walls, and horizontal top wall segments connected to said upper ends of said spaced-apart cavity side walls.

14. The expansion joint seal of claim 13, wherein said cavity top wall portions are connected to the lower ends of said passageway side walls, wherein said cavity top wall segments form an abutment surfaces for said snap-fit connector.

15. The expansion joint of claim 1, wherein said foam seal comprises a closed cell foam.

16. The expansion joint seal of claim 15, wherein said closed cell foam comprises a neoprene foam.

17. An expansion joint comprising:

spaced-apart structural members defining a gap therebetween; and the expansion joint seal of claim 1 coveting said gap between said spaced-apart structural members.

18. An expansion joint seal comprising;

a coverplate, wherein said coverplate comprises an elastomeric material;

a snap-fit connector depending downwardly from said coverplate;

a central spine connected to said coverplate by said snap-fit connector and extending downwardly from a connecting member; and at least one piece of expandable and compressible foam seal engaged with said central spine, wherein said coverplate comprises an elongated resilient elastomeric cover having a load bearing surface opposite a support surface including marginal support areas along opposite lateral edges thereof, said cover having a thickness and sufficient elasticity to elastically deform for establishing supporting contact between said marginal support areas and underlying horizontal structural members adjacent to a gap between said horizontal structural members; and a rigid plate member encapsulated within said elongated resilient cover for bridging a gap between said horizontal structural members.

19. An expansion joint seal comprising:

a coverplate, wherein said coverplate comprises an elastomeric material;

a snap-fit connector depending downwardly from said coverplate;

a central spine connected to said coverplate by said snap-fit connector and extending downwardly from a connecting portion; and at least one piece of expandable and compressible foam seal engaged with said central spine, wherein said coverplate comprises an elongated resilient cover having a predetermined width sufficient to overlie portions of horizontal structural members outwardly of marginal edges to a gap between the horizontal structural members, and a rigid plate member secured by and encapsulated within said elongated resilient cover, said rigid plate member defining an elongated bridging member having a width sufficient to span the width of a gap between horizontal structural members.

20. The expansion joint seal of claim 19, wherein said elongated resilient cover comprises peripheral edges including tapered face surfaces for providing incline planes to bear traffic traversing the coverplate.

21. An expansion joint seal comprising:

a coverplate;

a snap-fit connector depending downwardly from said coverplate;

a central spine connected to said coverplate by said snap-fit connector and extending downwardly from a connecting portion; and at least one piece of expandable and compressible foam seal engaged with said central spine, wherein said snap-fit connector comprises a horizontally extending top wall, spaced-apart side walls, a lower connecting segment connecting said side walls together, and a leg extending downwardly from said lower connecting segment and having upper and lower ends, said leg having a flange portion extending upwardly and outwardly from said lower end of said leg.

22. An expansion joint seal comprising:

a coverplate;

a snap-fit connector depending downwardly from said coverplate;

a central spine connected to said coverplate by said snap-fit connector and extending downwardly from a connecting portion; and at least one piece of expandable and compressible foam seal engaged with said central spine, wherein said snap-fit connector comprises a horizontally extending top wall, spaced-apart side walls extending downwardly from said top wall and having lower ends angled inwardly toward each other, a lower connecting segment extending between said lower ends of said side walls together, and flange portions extending upwardly and outwardly from said lower connecting portion.

23. An expansion joint seal comprising:

a coverplate;

a snap-fit connector depending downwardly from said coverplate;

a central spine connected to said coverplate by said snap-fit connector and extending downwardly from a connecting portion; and at least one piece of expandable and compressible foam seal engaged with said central spine, wherein said snap-fit connector comprises a horizontally extending top wall, spaced-apart side walls extending downwardly from said top wall and having lower ends angled inwardly toward each other, spaced-apart bottom walls extending horizontally from said lower ends of each of said spaced-apart side walls and from the midline of said snap-fit connector, and flange portions extending upwardly and outwardly from said lower ends of each of said spaced-apart bottom walls.

24. The expansion joint seal of claim 23, wherein said snap-fit connector is inserted into said upper passageway of said means for accepting of said central spine, wherein said side walls of snap-fit connector are in abutting contact with said passageway side walls, and wherein said flange portions of said snap-fit connector extends downwardly into said lower cavity of said means for accepting of said central spine.

* * * * *